US009308638B2

(12) United States Patent
Kondo et al.

(10) Patent No.: US 9,308,638 B2
(45) Date of Patent: Apr. 12, 2016

(54) POWER TOOL AND AUXILIARY HANDLE MEMBER

(71) Applicant: MAKITA CORPORATION, Anjo-shi, Aichi (JP)

(72) Inventors: Tomoyuki Kondo, Anjo (JP); Takao Kuroyanagi, Anjo (JP)

(73) Assignee: Seiko Epson Corporation, Tokyo (JP)

( * ) Notice: Subject to any disclaimer, the term of this patent is extended or adjusted under 35 U.S.C. 154(b) by 554 days.

(21) Appl. No.: 13/743,746

(22) Filed: Jan. 17, 2013

(65) Prior Publication Data

US 2014/0196921 A1 Jul. 17, 2014

(51) Int. Cl.

| | |
|---|---|
| ***B25F 5/02*** | (2006.01) |
| ***B25D 17/04*** | (2006.01) |
| ***B25G 1/00*** | (2006.01) |

(52) U.S. Cl.

CPC . *B25F 5/02* (2013.01); *B25F 5/026* (2013.01); *B25G 1/00* (2013.01); *Y10T 16/4713* (2015.01)

(58) Field of Classification Search

CPC ..... B25F 5/026; B25F 5/02; B25D 17/04; B25G 1/00

USPC ..... 173/217, 46; 16/110.1, 406, 422, 426

See application file for complete search history.

(56) References Cited

U.S. PATENT DOCUMENTS

| | | | | |
|---|---|---|---|---|
| 1,647,396 | A | 6/1925 | Decker | |
| 2,158,228 | A | 5/1939 | Forss | |
| 5,265,312 | A * | 11/1993 | Okumura | 24/3.12 |
| 7,000,709 | B2 | 2/2006 | Milbourne | |
| 7,101,300 | B2 * | 9/2006 | Milbourne et al. | 475/265 |
| 2007/0209162 | A1 | 9/2007 | McRoberts et al. | |
| 2011/0025207 | A1 | 2/2011 | Nagasaka et al. | |
| 2011/0120741 | A1 | 5/2011 | Limberg et al. | |
| 2014/0251649 | A1 | 9/2014 | Kondo | |

FOREIGN PATENT DOCUMENTS

| | | | |
|---|---|---|---|
| FR | 2620068 | A1 | 3/1989 |
| GB | 2203363 | A | 10/1988 |
| WO | 2010/052881 | A1 | 5/2010 |

* cited by examiner

*Primary Examiner* — Michelle Lopez

(74) *Attorney, Agent, or Firm* — Global IP Counselors, LLP

(57) ABSTRACT

A power tool includes a main body portion and a grip portion. The main body portion includes a motor unit. The grip portion extends from the main body portion between a front end and a rear end of the main body portion. The main body portion further includes an auxiliary handle mounting structure disposed between the rear end of the main body portion and a rearmost end of a region where the grip portion meets the main body portion. An auxiliary handle member is coupled to the auxiliary handle mounting structure of the main body portion.

25 Claims, 21 Drawing Sheets

POWER TOOL AND AUXILIARY HANDLE MEMBER

BACKGROUND

1. Field of the Invention

The present invention generally relates to a power tool. More specifically, the present invention relates to a power tool with an auxiliary handle member removably coupled to the power tool.

2. Background Information

A conventional power tool, such as a driver drill, a hammer drill, an impact driver drill and the like, often includes a pistol-shaped housing having a grip portion, which is usually grasped by a user with one hand during operation. However, it is sometimes difficult to gain sufficient leverage to properly operate the power tool by holding the power tool with only one hand. Therefore, it is well known to provide an auxiliary handle or side handle on the power tool to enable the user to support the power tool with both hands during operation.

For example, U.S. Pat. No. 7,000,709 discloses a side handle mounted on a driver drill. The driver drill disclosed in this patent includes a pistol-shaped housing, a collar mounted at a front portion of the housing, and an annular cap provided forward of the collar. The side handle includes a grip portion and an annular mounting portion that slides over an outer surface of the annular cap of the driver drill so that the side handle is secured to the driver drill at the front portion of the housing.

SUMMARY

In the conventional auxiliary handle mounting structure for the power tool as discussed above, the auxiliary handle is fixed to an annular mounting area formed at a front portion of the housing. Therefore, it is required to provide a sufficient space in the front portion of the housing in order to form the annular mounting area at the front portion of the housing, which increases a longitudinal length of the housing. However, when the longitudinal length of the power tool is large, it becomes difficult to use the power tool in a small, confined space. Also, since the auxiliary handle is coupled to the front portion of the housing as in the conventional power tool, the auxiliary handle may interfere with a target workpiece on which work is being done with the power tool when the target workpiece has a shape that bulges out towards the power tool.

Moreover, an auxiliary handle has been conventionally provided only for large-size, high torque power tools. In other words, for small size, lightweight power tools, it has been even more difficult to provide a sufficient space for forming the mounting area for the auxiliary handle due to space limitation of the housings for such small size power tools. However, the maximum output torque of small size power tools has increased in recent years and, thus, the reaction force that acts on small size power tools during operation has also increased. Therefore, there has been a need for providing an auxiliary handle not only on the large size power tools but also on small size power tools.

Furthermore, in the conventional auxiliary handle mounting structure, the auxiliary handle slides onto an outer surface of the housing. Therefore, when large torque is imparted on the power tool during operation, the auxiliary handle may accidentally slip off from the housing of the power tool or become misaligned with respect to the housing.

In view of the state of the known technology, a power tool according to one aspect includes a main body portion and a grip portion. The main body portion includes a motor unit.

The grip portion extends from the main body portion between a front end and a rear end of the main body portion. The main body portion further includes an auxiliary handle mounting structure disposed between the rear end of the main body portion and a rearmost end of a region where the grip portion meets the main body portion.

A power tool according to another aspect includes a main body portion and a grip portion. The main body portion includes a motor unit. The grip portion extends from the main body portion between a front end and a rear end of the main body portion. The main body portion further includes an auxiliary handle mounting structure disposed at a position at least partially overlapping the motor unit as viewed along a direction perpendicular to a rotational axis of the motor unit.

A power tool according to another aspect includes a main body portion and a grip portion. The main body portion includes a motor unit. The grip portion extends from the main body portion. The main body portion further includes an auxiliary handle mounting structure defining a through-hole extending through the main body portion.

A power tool according to another aspect includes a main body portion, a grip portion and a rechargeable battery with a maximum voltage of 12.0 V or less. The main body portion includes a motor unit. The grip portion extends from the main body portion. The main body portion includes an auxiliary handle mounting structure configured and arranged to be coupled to an auxiliary handle member.

A power tool according to another aspect includes a housing and a motor assembly. The housing includes a main body portion and a grip portion extending from the main body portion. The motor assembly is disposed in the main body portion of the housing. The motor assembly includes a motor unit and a generally cylindrical motor casing member enclosing the motor unit. The main body portion of the housing includes an auxiliary handle mounting structure configured and arranged to be coupled to an auxiliary handle member.

An auxiliary handle member according to another aspect is adapted to be coupled to a housing of a power tool. The auxiliary handle member includes an auxiliary grip portion and a fixing portion. The fixing portion is coupled to the auxiliary grip portion, and includes an insertion section configured and arranged to pass through the housing of the power tool.

Other objects, features, aspects and advantages of the disclosed power tool with the auxiliary handle member will become apparent to those skilled in the art from the following detailed description, which, taken in conjunction with the annexed drawings, discloses preferred embodiments of the power tool with the auxiliary handle member.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Referring initially to FIGS. 1 to 7, a power tool 10 with an auxiliary handle member 100 is illustrated in accordance with a first embodiment. The auxiliary handle member 100 is selectively coupled with the power tool 10 to provide a secondary grip position for a user to support the power tool 10 with both hands during operation.

Figure 1:
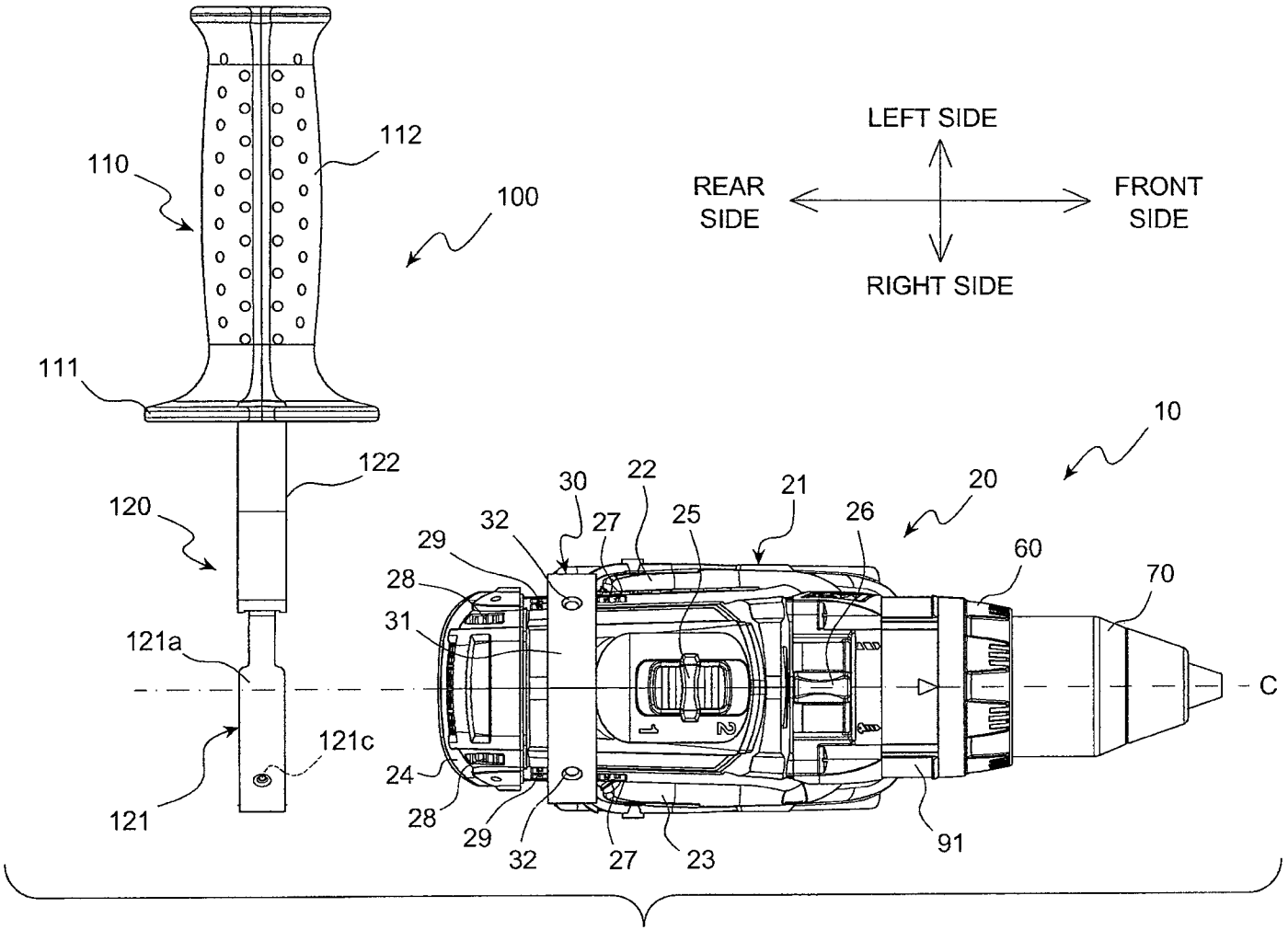
FIG. 1 is an exploded, top plan view of a power tool with an auxiliary handle member according to a first embodiment.
Figure 2:
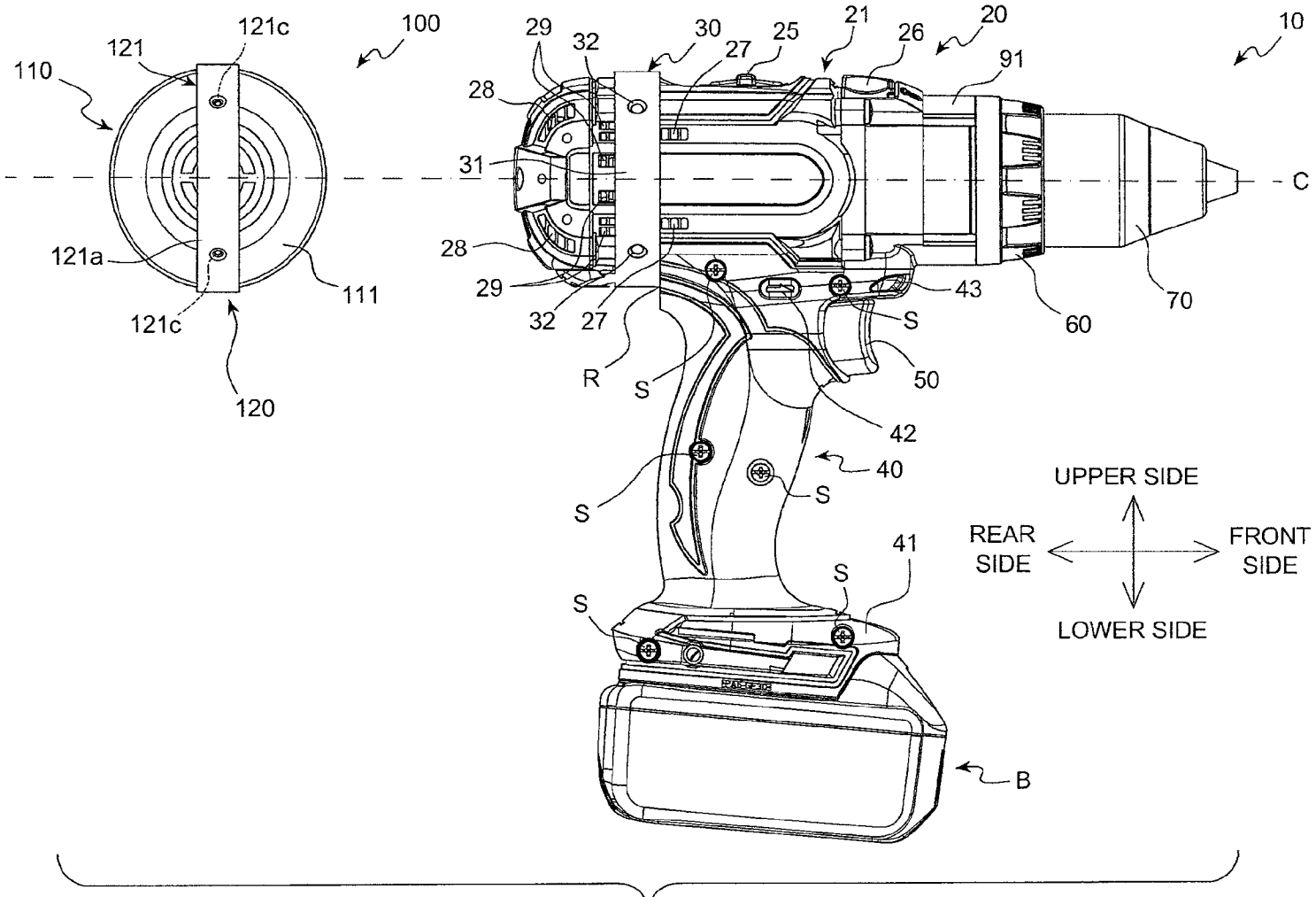
FIG. 2 is an exploded, side elevational view of the power tool with the auxiliary handle member illustrated in FIG. 1.

In the embodiment illustrated in FIGS. 1 to 7, the power tool 10 is a cordless driver drill. As shown in FIG. 2, the power tool 10 has a generally pistol-like overall shape formed by a generally tubular main body portion 20 with an auxiliary handle mounting structure 30, and a grip portion 40. The grip portion 40 extends downwardly from the main body portion 20 between a front end and a rear end of the main body portion 20. An outer surface of at least a part of the main body portion 20 and the grip portion 40 are integrally formed to define an outer housing cover 21. The outer housing cover 21 is preferably made of resin material. More specifically, the outer housing cover 21 includes a left housing cover 22, a right housing cover 23 and a rear housing cover 24. The left housing cover 22 and the right housing cover 23 are fixed together by a plurality of screws S (see, FIG. 2). Moreover, the main body portion 20 includes a speed change lever 25 for changing a rotational speed of the power tool 10, and a driver-drill change lever 26 for switching an operation mode of the power tool 10 between a driver mode for screwing and a drill mode for drilling. The main body portion 20 further includes a plurality of openings defining front intake ports 27, rear intake ports 28 and exhaust ports 29. Cooling air enters into the main body portion 20 through the front intake ports 27 or the rear intake ports 28, and the cooling air is discharged from the exhaust ports 29, thereby forming cooling air passages that flow through inside of the main body portion 20 for cooling internal components accommodated in the main body portion 20.

As shown in FIG. 2, a trigger-type switch lever 50 is provided at an upper end region of the grip portion 40 for driving the power tool 10. A lower end of the grip portion 40 includes a battery connecting portion 41, which is coupled to a rechargeable battery B. The battery B serves as a power source for the power tool 10. Preferably, the rechargeable battery B is removably attached to the lower end of the grip portion 40. The rechargeable battery B is a conventional battery such as a lithium-ion battery, a nickel cadmium battery, etc. In this embodiment, the rechargeable battery B has a relatively high voltage (e.g., 14.4 V or greater) so that the power tool 10 is operable with a relatively high torque. A rotational direction change lever 42 is provided in a region where the grip portion 40 meets the main body portion 20 for switching a rotational direction of the power tool 10. A light unit 43 is provided in a front end of the region where the grip portion 40 meets the main body portion 20 for illuminating the work area.

A tubular change-ring 60 is disposed on a front side of the main body portion 20 so as to be rotatable about a center axis C of the main body portion 20 to adjust a rotation torque. The tubular change-ring 60 is coupled to a spindle 61 (see, FIG. 6). A power tool chuck 70 is attached around a front end part of the spindle 61 for holding a tool piece (not shown). The tool piece includes, for example, a drill bit, a screwdriver bit, etc.

Figure 6:
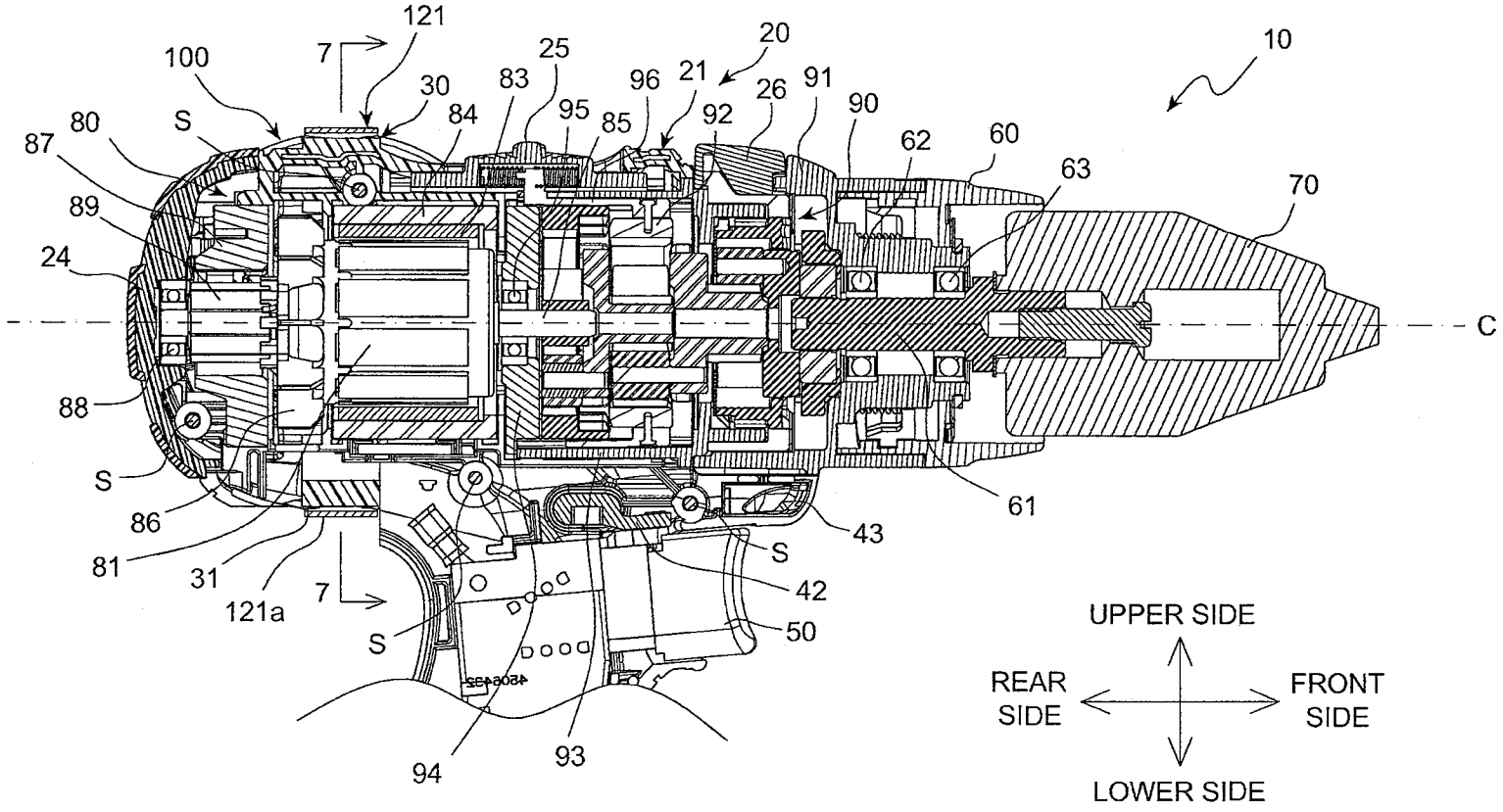
FIG. 6 is a partial cross sectional view of a main body portion of the power tool with the auxiliary handle member illustrated in FIG. 5 as taken along a section line 6-6 in FIG. 5.

As shown in FIG. 6, a motor unit 80 is disposed in a rear portion of the main body portion 20. The motor unit 80 includes a rotor having an armature core 81 and armature coils 82 and a stator having a magnet 83 and a stator core 84

Figure 7:
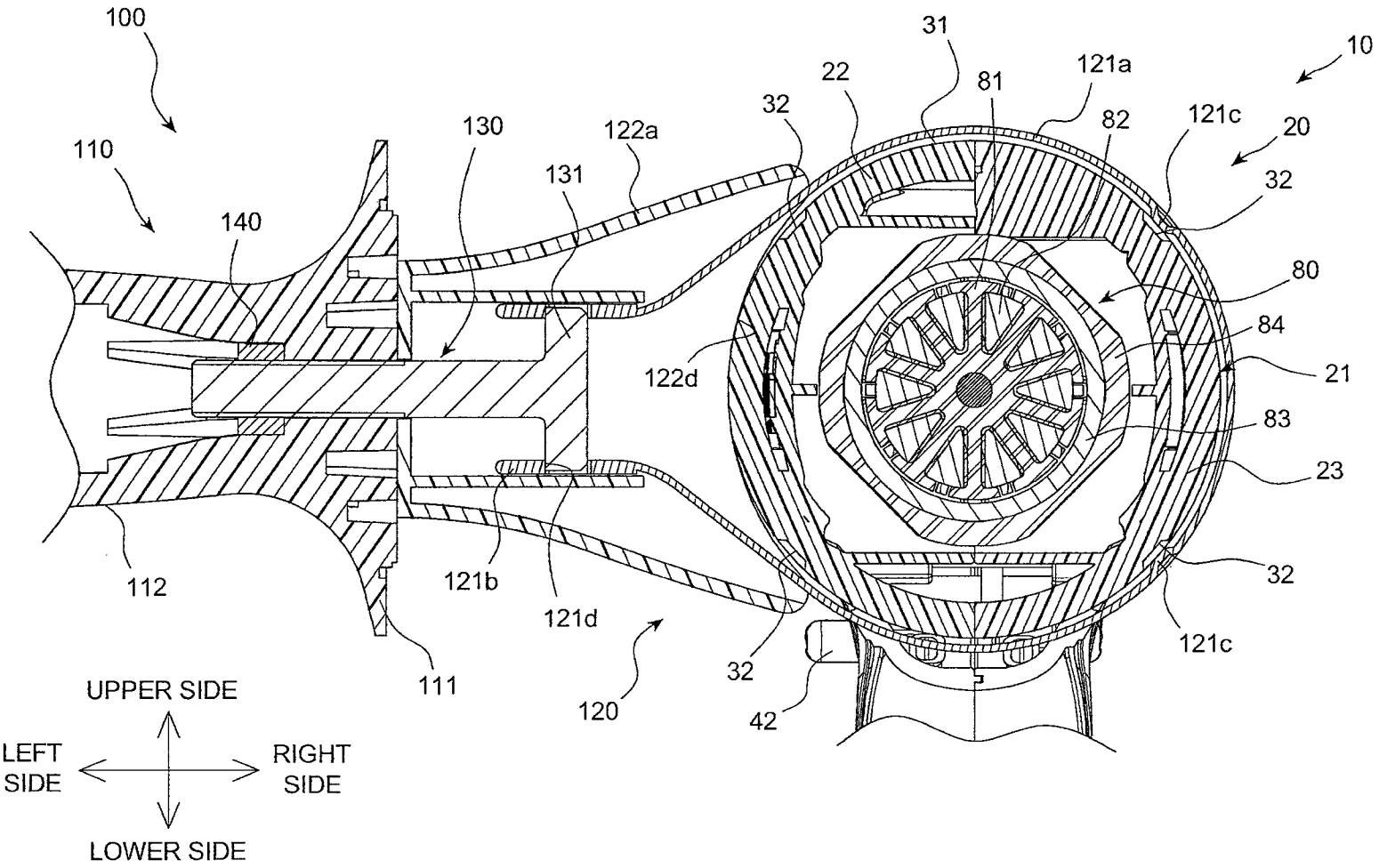
FIG. 7 is a partial cross sectional view of the main body portion of the power tool and a fixing portion of the auxiliary handle member illustrated in FIGS. 5 and 6 as taken along a section line 7-7 in FIG. 6.

(see, FIG. 7). The motor unit 80 further includes conventional components such as an output shaft 85, a fan 86, a brush holder 87, a rear bearing 88 and a commutator 89. In FIG. 6, some parts of the motor unit 80 (such as the rotor) are not shown in cross section for the sake of simplicity of illustration.

As shown in FIG. 6, a gear assembly 90 is disposed in front of the motor unit 80 inside the main body portion 20. The spindle 61 is coupled to the gear assembly 90 so that the gear assembly 90 transmits rotation of the output shaft 85 of the motor unit 80 to the power tool chuck 70 via the spindle 61, when the switch lever 50 is operated. More specifically, the gear assembly 90 includes a generally cylindrical gear box cover 91 disposed between the main body portion 20 and the tubular change-ring 60, a plurality of gears including an internal gear 92, a gear box 93 enclosing the plurality of gears, and a gear box lid 94 covering a rear end of the gear box 93. The spindle 61 is rotatably supported by a pair of bearings 62 and 63 that are fixed to the gear box cover 91. A front bearing 95 is coupled to the gear box lid 94 for rotatably supporting the output shaft 85 of the motor unit 80. The speed change lever 25 is operatively coupled to the internal gear 92 via a connecting ring 96 so that a rotational speed of the power tool 10 (i.e., a rotational speed of the spindle 61) is changed by operating the speed change lever 25.

Since the components of the power tool 10, such as the tubular change ring 60, the power tool chuck 70, the motor unit 80 and the gear assembly 90, are conventional components that are well known in the art, the structure of these components will not be discussed or illustrated in detail herein. Rather, it will be apparent to those skilled in the art from this disclosure that the components of the power tool 10 can have any type of suitable structure.

Referring back to FIGS. 1 and 2, the auxiliary handle mounting structure 30 is disposed between the rear end of the main body portion 20 and a rearmost end position R of a region where the grip portion 40 meets the main body portion 20. The auxiliary handle mounting structure 30 includes a generally cylindrical surface 31 that is formed on the main body portion 20. Four recesses 32 are formed in the generally cylindrical surface 31. The recesses 32 form an engagement structure of the auxiliary handle mounting structure 30. While four of the recesses 32 are illustrated, fewer or more of such recesses 32 can be used. Alternatively, the recesses can be eliminated. Preferably, at least one of the recesses 32 or some other anti-rotation or anti-misalignment feature is provided between the auxiliary handle mounting structure 30 and the auxiliary handle member 100. In this embodiment, the recesses 32 are spaced apart from each other along the circumferential direction of the cylindrical surface 31 (see, FIG. 7). The auxiliary handle mounting structure 30 is preferably integrally formed with the main body portion 20 of the power tool 10. For example, when the outer housing cover 21 of the power tool 10 is made as a molded member, a structure corresponding to the auxiliary handle mounting structure (i.e., the cylindrical surface 31 and the recesses 32) can be formed (molded) simultaneously along with other portions of the outer housing cover 21. Therefore, the auxiliary handle mounting structure 30 can be formed on the power tool 10 in a simple manner without additional parts.

As shown in FIG. 6, the auxiliary handle mounting structure 30 is disposed at a position at least partially overlapping the motor unit 80 as viewed along a direction perpendicular to a rotational axis of the motor unit 80, which coincides the center axis C of the main body portion 20. More specifically, the auxiliary handle mounting structure 30 is preferably disposed at a position at least partially overlapping at least one of the rotor and the stator of the motor unit 80 as viewed along the direction perpendicular to the rotational axis of the motor unit 80.

Figure 4:
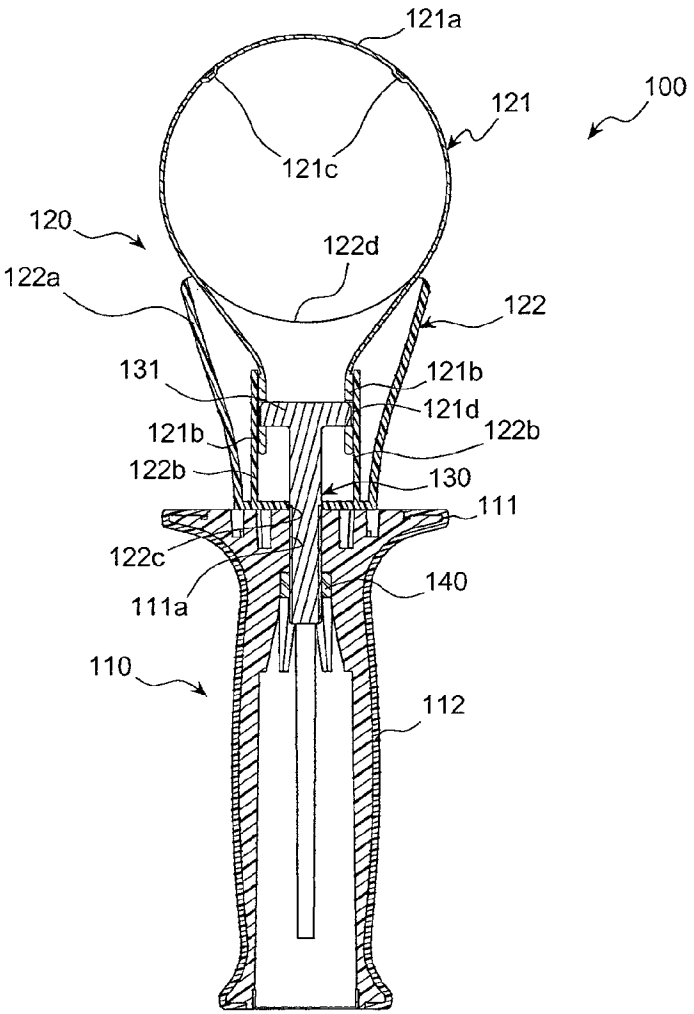
FIG. 4 is a longitudinal cross sectional view of the auxiliary handle member illustrated in FIG. 3.
Figure 3:
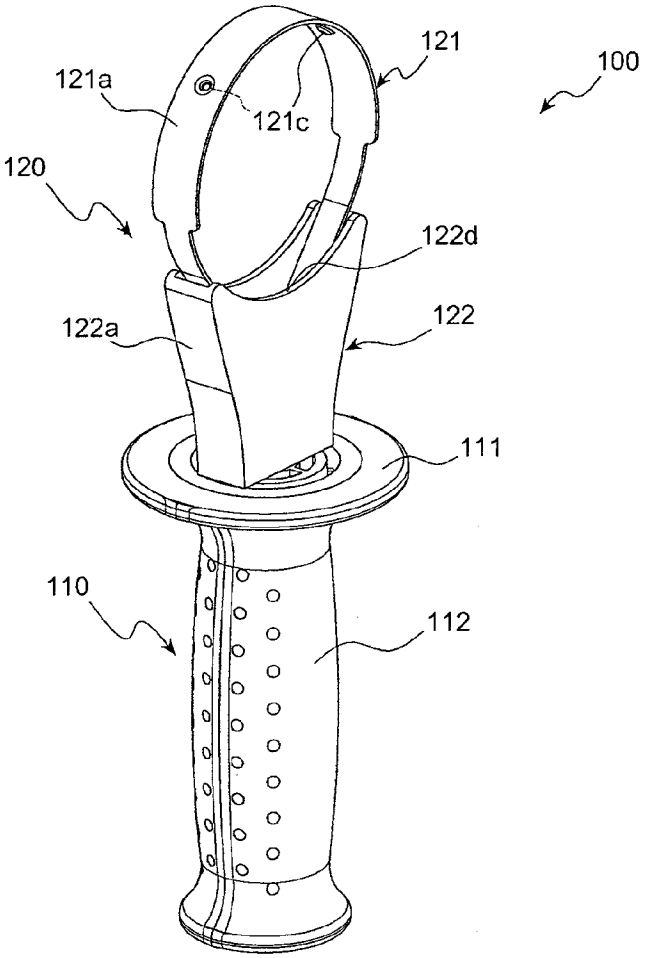
FIG. 3 is a perspective view of the auxiliary handle member illustrated in FIGS. 1 and 2.

Referring now to FIGS. 3 and 4, the structure of the auxiliary handle member 100 will now be described. The auxiliary handle member 100 is an auxiliary tool that is removably coupled to the power tool 10 to provide a secondary grip portion for a user to support the power tool 10 with both hands during operation. The auxiliary handle member 100 basically includes an auxiliary grip portion 110 and a fixing portion 120. The fixing portion 120 is rotatably coupled to the auxiliary grip portion 110 by a bolt 130 and a nut 140. The fixing portion 120 is configured and arranged to be fixed to the auxiliary handle mounting structure 30 of the main body portion 20 of the power tool 10 as described in more detail below.

The auxiliary grip portion 110 of the auxiliary handle member 100 includes a flange section 111 and a body section 112. As shown in FIG. 4, a through-hole 111*a* is formed in the flange section 111 for passing the bolt 130. The nut 140 engages with the bolt 130 to fix the bolt 130 to an inner end part of the through-hole 111*a*. An outer surface of the body section 112 is preferably made of rubber or plastic material, and may be provided with an anti-slip surface structure or coating to prevent the user's hand from slipping during operation.

As shown in FIGS. 3 and 4, the fixing portion 120 of the auxiliary handle member 100 includes a fastening member 121 and a case member 122. The fastening member 121 is a leaf-spring that is formed by a strip element. The fastening member 121 includes a ring section 121*a* and a pair of parallel plate sections 121*b*. The parallel plate sections 121*b* are bent and extend outwardly in a generally radial direction at both ends of the ring section 121*a*. As shown in FIG. 3, the fastening member 121 includes a wider width section in a middle region in a longitudinal direction of the fastening member 121 and narrower width sections at distal end regions of the fastening member 121. Each of the parallel plate sections 121*b* of the fastening member 121 defines an opening 121*d* through which one end of a head part 131 of the bolt 130 is inserted as shown in FIG. 4, with the head part 131 of the bolt 130 having a generally rectangular shape. In a non-gripping state, the ring section 121*a* has an inner diameter that is larger than a maximum dimension of the rear end of the main body portion 20. By turning the nut 140, as explained below, the inner diameter of the ring section 121*a* is reduced to a dimension that is slightly larger than a diameter of the cylindrical surface 31 of the auxiliary handle mounting structure 30 that is formed in the main body portion 20 of the power tool 10. In other words, when the auxiliary handle member 100 is coupled to the power tool 10, the ring section 121*a* is slid onto the cylindrical surface 31 of the auxiliary handle mounting structure 30, and then tightened onto the cylindrical surface 31 in the radial direction. Any suitable resilient material, such as metal, resin, etc. can be used to form the fastening member 121.

The ring section 121*a* of the fastening member 121 includes two protrusions 121*c* that define an engagement structure. The protrusions 121*c* protrude inwardly in a generally radial direction from an inner circumference surface of the ring section 121*a*. In this embodiment, the ring section 121*a* includes two of the protrusions 121*c*. However, fewer or more protrusions can be used if needed and/or desired. Each of the protrusions 121*c* is configured and arranged to engage with one of the recesses 32 of the auxiliary handle mounting structure 30 when the auxiliary handle member 100 is tightened onto the power tool 10 to prevent misalignment and/or rotation between the auxiliary handle member 100 and the power tool 10 during operation. The protrusions 121*c* are spaced apart from each other by a prescribed distance corresponding to a distance between the recesses 32 of the auxiliary handle mounting structure 30.

The case member 122 of the fixing portion 120 accommodates and supports the fastening member 121 with a majority of the ring section 121*a* being exposed. The case member 122 includes an outer cover 122*a* and a pair of inner walls 122*b*. The outer cover 122*a* is generally rectangular in cross-section. The outer cover 122*a* accommodates the narrower width sections of the fastening member 121. The inner walls 122*b* extend parallel to each other between opposing surfaces of the outer cover 122*a*. The inner walls 122*b* slideably support the parallel plate sections 121*b* of the fastening member 121 with the head part 131 of the bolt 130 being coupled to the parallel plate sections 121*b* as shown in FIG. 4. A through-hole 122*c*, through which the bolt 130 passes, is provided at a bottom surface of the case member 122. An open end of the outer cover 122*a* includes an abutment section 122*d* having an outline that generally matches a contour of an outer surface of the outer housing cover 21 at the auxiliary handle mounting structure 30.

Accordingly, the parallel plate sections 121*b* of the fastening member 121 moves with the bolt 130 between the inner walls 122*b* of the case member 122 in an axial direction of the bolt 130. Therefore, when the auxiliary grip portion 110 is rotated around the center axis of the bolt 130 relative to the case member 122 while the nut 140 threadedly engages with the bolt 130, the bolt 130 moves in the axial direction. The parallel plate sections 121*b* of the fastening member 121 also move along with the bolt 130 in a direction protruding from or retracting toward the inner walls 122*b* depending on the rotation direction of the bolt 130 with respect to the nut 140. Therefore, the inner diameter of the ring section 121*a* increases or decreases as the auxiliary grip portion 110 is rotated with respect to the case member 122. More specifically, the inner diameter of the ring section 121*a* decreases as the bolt 130 and the parallel plate sections 121*b* are retracted in the inner walls 122*b* and end portions of the ring section 121*a* are pushed closer together by the inner walls 122*b*.

Figure 5:
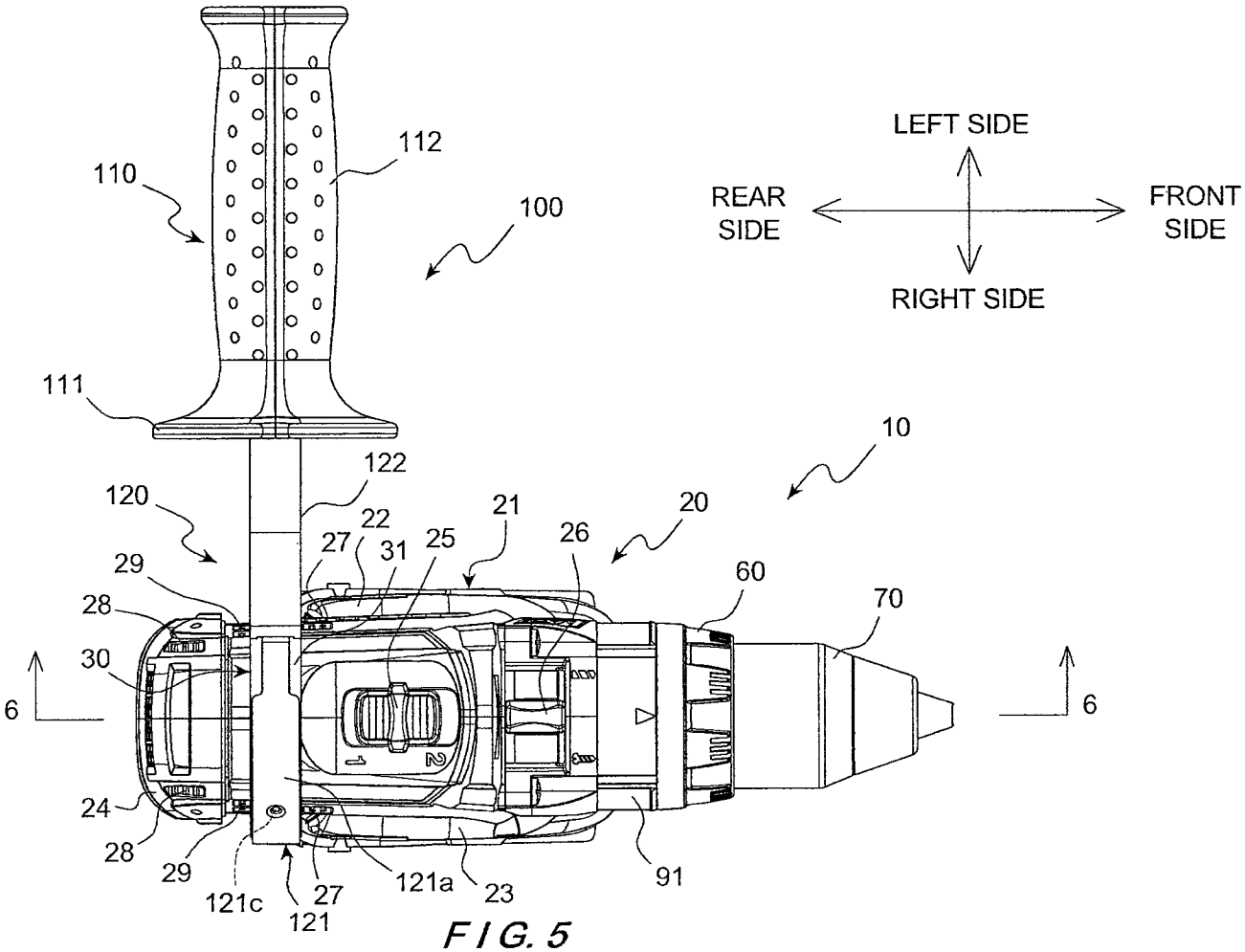
FIG. 5 is a top plan view of the power tool with the auxiliary handle member illustrated in FIGS. 1 and 2, illustrating a state in which the auxiliary handle member is coupled to the power tool.

FIGS. 5 and 6 show the auxiliary handle member 100 and the power tool 10 when the fixing portion 120 of the auxiliary handle member 100 is coupled to the auxiliary handle mounting structure 30 of the power tool 10. FIG. 5 shows a top plan view of the auxiliary handle member 100 and the power tool 10, while FIGS. 6 and 7 show cross-sectional views of the auxiliary handle member 100 and the power tool 10. More specifically, FIGS. 6 and 7 show the auxiliary handle member 100 and the power tool 10 before the fixing portion 120 of the auxiliary handle member 100 is completely tightened onto the auxiliary handle mounting structure 30 of the power tool 10.

When the auxiliary handle member 100 is attached to the power tool 10, first, the auxiliary grip portion 110 is rotated in a first direction (e.g., counterclockwise) with respect to the case member 122 to move the bolt 130 in a direction in which the parallel plate sections 121*b* protrude from the inner walls 122*b*. Therefore, the fastening member 121 is pushed outwardly from the case member 122 and the inner diameter of the ring section 121*a* increases to allow passage of the rear end part of the main body portion 20 of the power tool 10. Next, the rear end part of the main body portion 20 of the power tool 10 is passed through a space formed between the ring section 121*a* of the fastening member 121 and the case member 122 of the auxiliary handle member 100 as shown in FIG. 5. At this time, the auxiliary handle member 100 is positioned with respect to the power tool 10 so that the protrusions 121*c* of the fastening member 121 face the recesses 32 of the auxiliary handle mounting structure 30 as shown in FIG. 7. Then, the auxiliary grip portion 110 of the auxiliary handle member 100 is turned in a second direction (e.g., clockwise) with respect to the case member 122 to move the bolt 130 in a direction in which the parallel plate sections 121*b* is retracted toward the inner walls 122*b*. As the bolt 130 moves, the ring section 121*a* of the fastening member 121 is also retracted toward the case member 122, and the fastening member 121 is tightened onto the auxiliary handle mounting structure 30 of the main body portion 20 of the power tool 10. Therefore, the auxiliary handle member 100 is fastened onto the power tool 10 as the auxiliary mounting structure 30 of the main body portion 20 is clutched between the fastening member 121 and the abutment sections 122*b* of the case member 122.

With the power tool 10 according to the first embodiment, the auxiliary handle mounting structure 30 is disposed between the rear end of the main body portion 20 and the rearmost end position R of the region where the grip portion 40 meets the main body portion 20 as shown in FIG. 2. Moreover, as shown in FIG. 6, the auxiliary handle mounting structure 30 is disposed at a position at least partially overlapping the motor unit 80 as viewed along a direction perpendicular to the rotational axis of the motor unit 80. Furthermore, as shown in FIG. 2, the auxiliary handle mounting structure 30 according to this embodiment is disposed at a position between the front intake ports 27 and the rear intake ports 28 formed in the outer housing cover 21 of the main body portion 20. More specifically, in this embodiment, the auxiliary handle mounting structure 30 is disposed at a position between the front intake ports 27 and the exhaust ports 29. In other words, the auxiliary handle member 100 is attached to the power tool 10 on the rear side of the main body portion 20. Accordingly, with the power tool 10 according to the first embodiment, it is not necessary to provide an extra space in the front portion of the main body portion 20 for forming the auxiliary handle mounting structure 30. In other words, the existing space on the rear side of the main body portion 20, where the motor unit 80 is disposed, can be efficiently used to form the auxiliary handle mounting structure 30. Therefore, the overall longitudinal length of the main body portion 20 of the power tool 10 can be prevented from being increased. Thus, the usability of the power tool 10 with the auxiliary handle member 100 is improved even in a confined working space. Moreover, since the auxiliary handle member 100 is attached on the rear side of the grip portion 40, the auxiliary handle member 100 is prevented from interfering with a target workpiece even when the target workpiece has a shape that bulges out towards the power tool 10.

Figure 8:
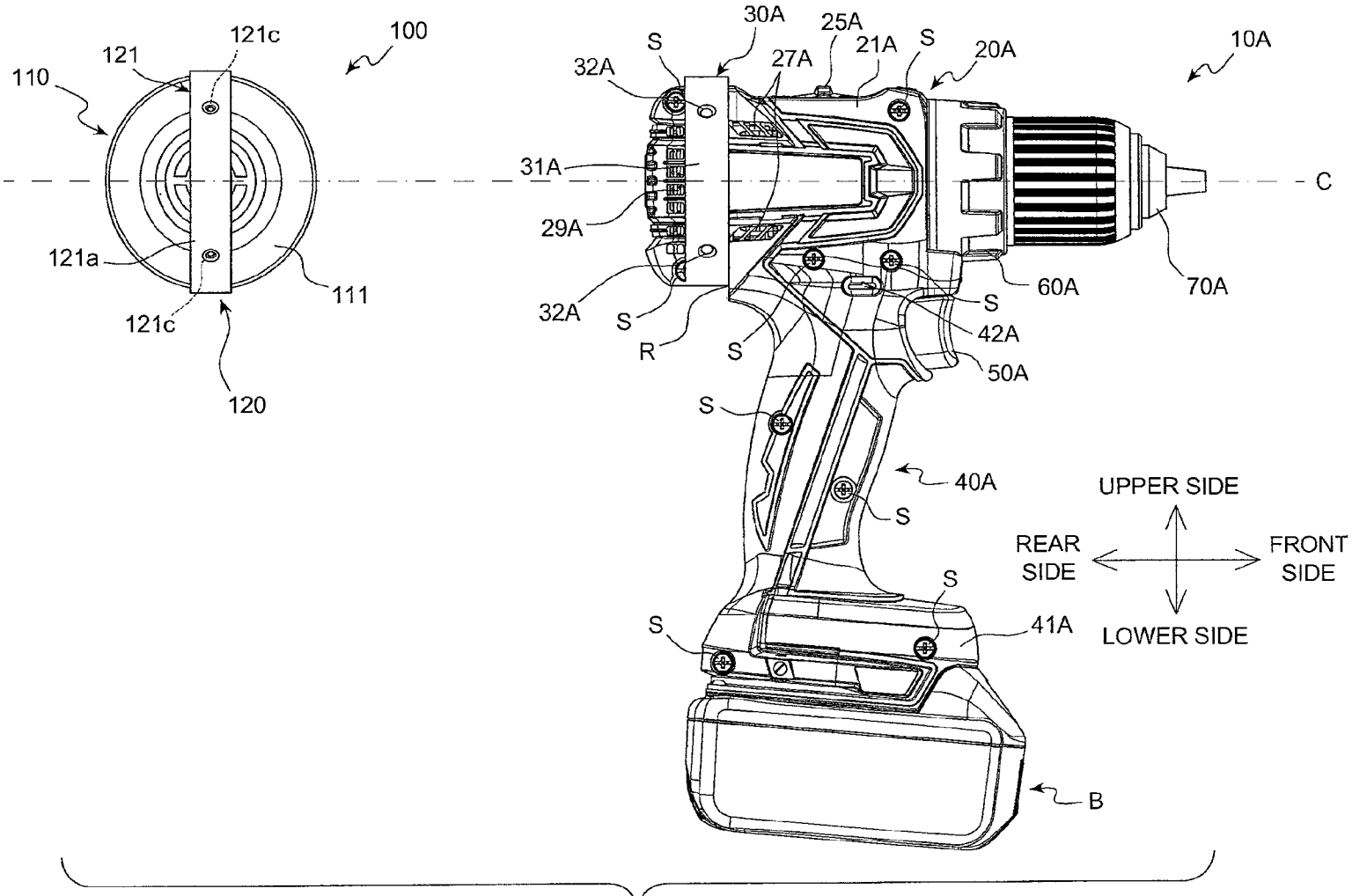
FIG. 8 is an exploded, side elevational view of a power tool with the auxiliary handle member according to a modified example of the first embodiment.
Figure 9:
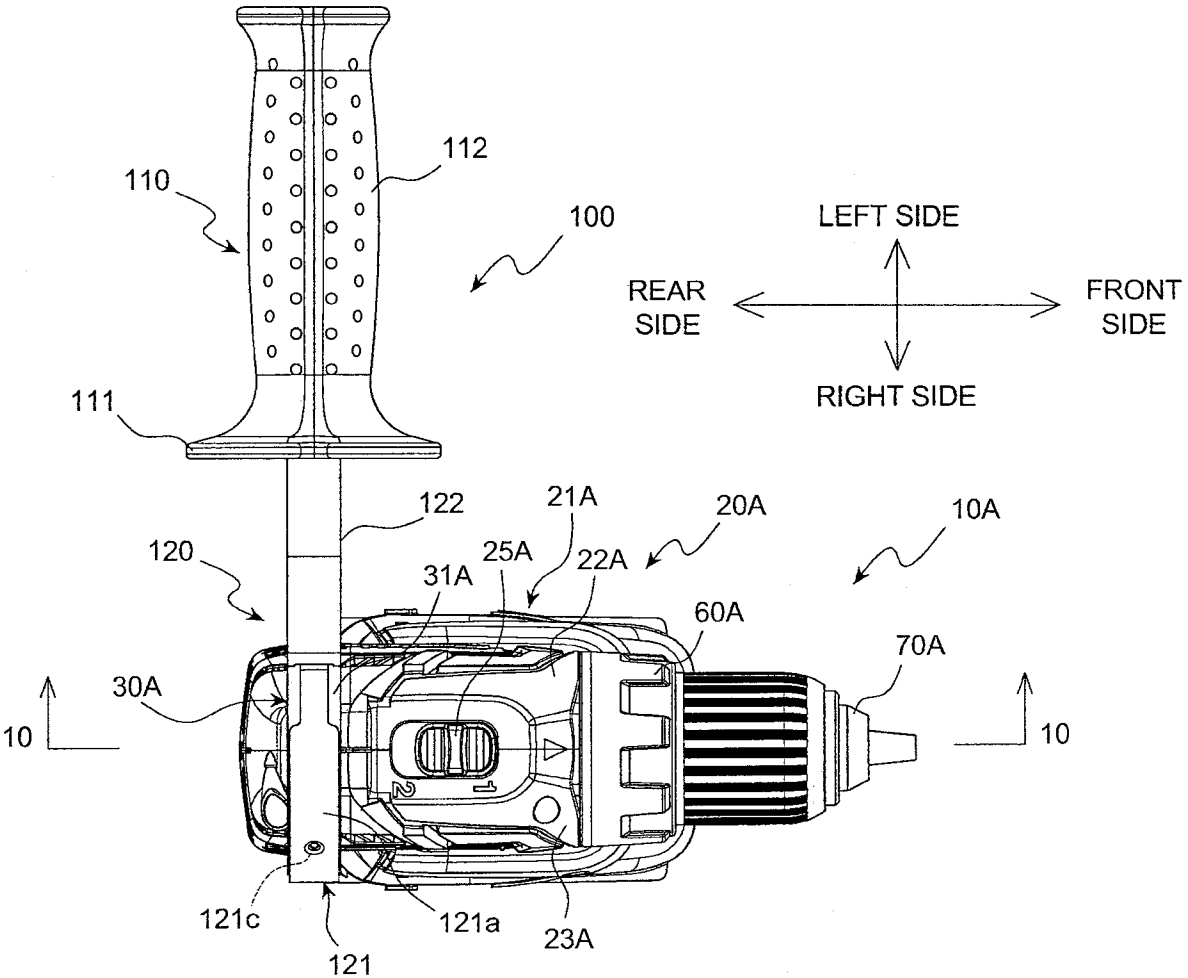
FIG. 9 is a top plan view of the power tool with the auxiliary handle member illustrated in FIG. 8, illustrating a state in which the auxiliary handle member is coupled to the power tool.
Figure 10:
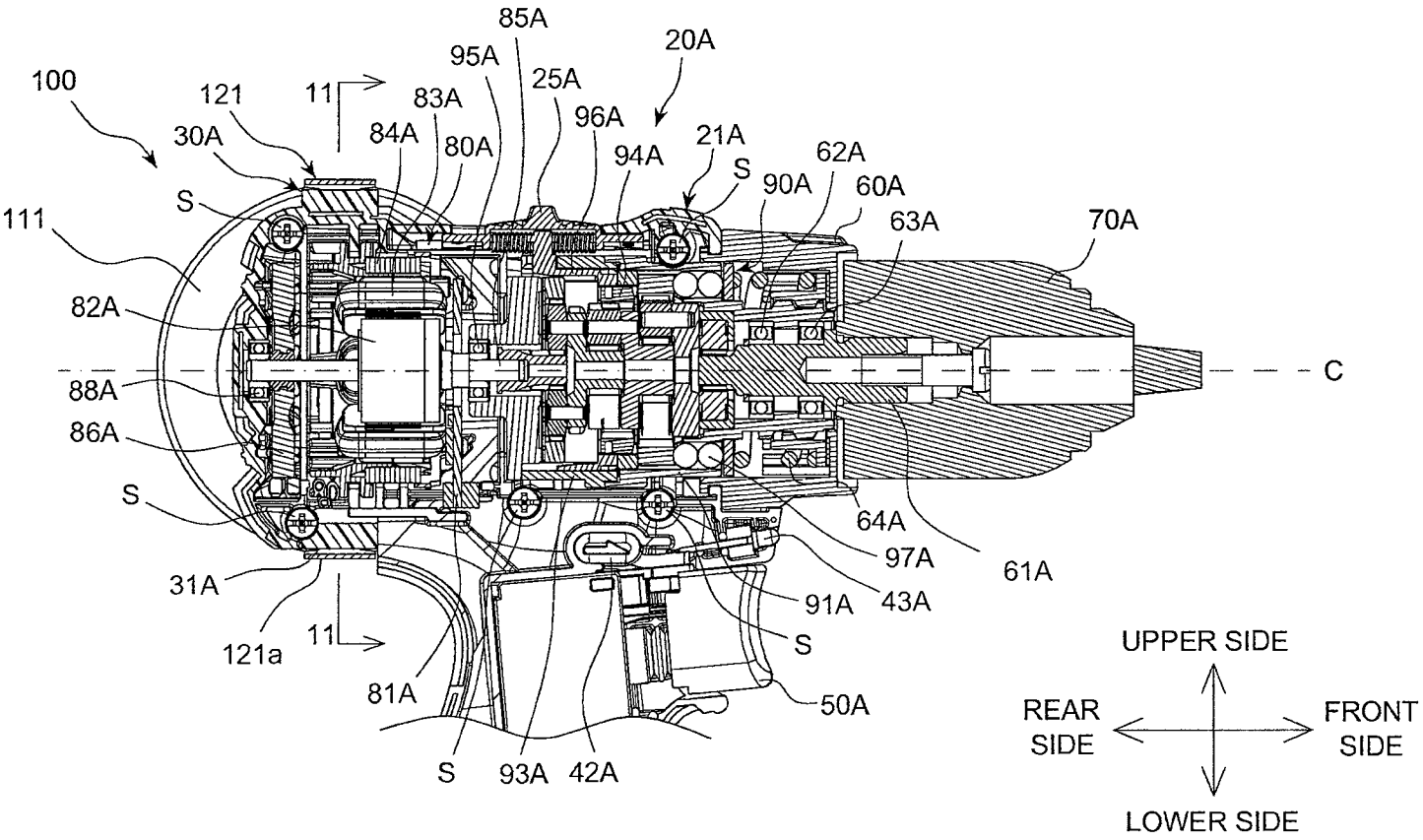
FIG. 10 is a partial cross sectional view of a main body portion of the power tool with the auxiliary handle member illustrated in FIG. 9 as taken along a section line 10-10 in FIG. 9.
Figure 11:
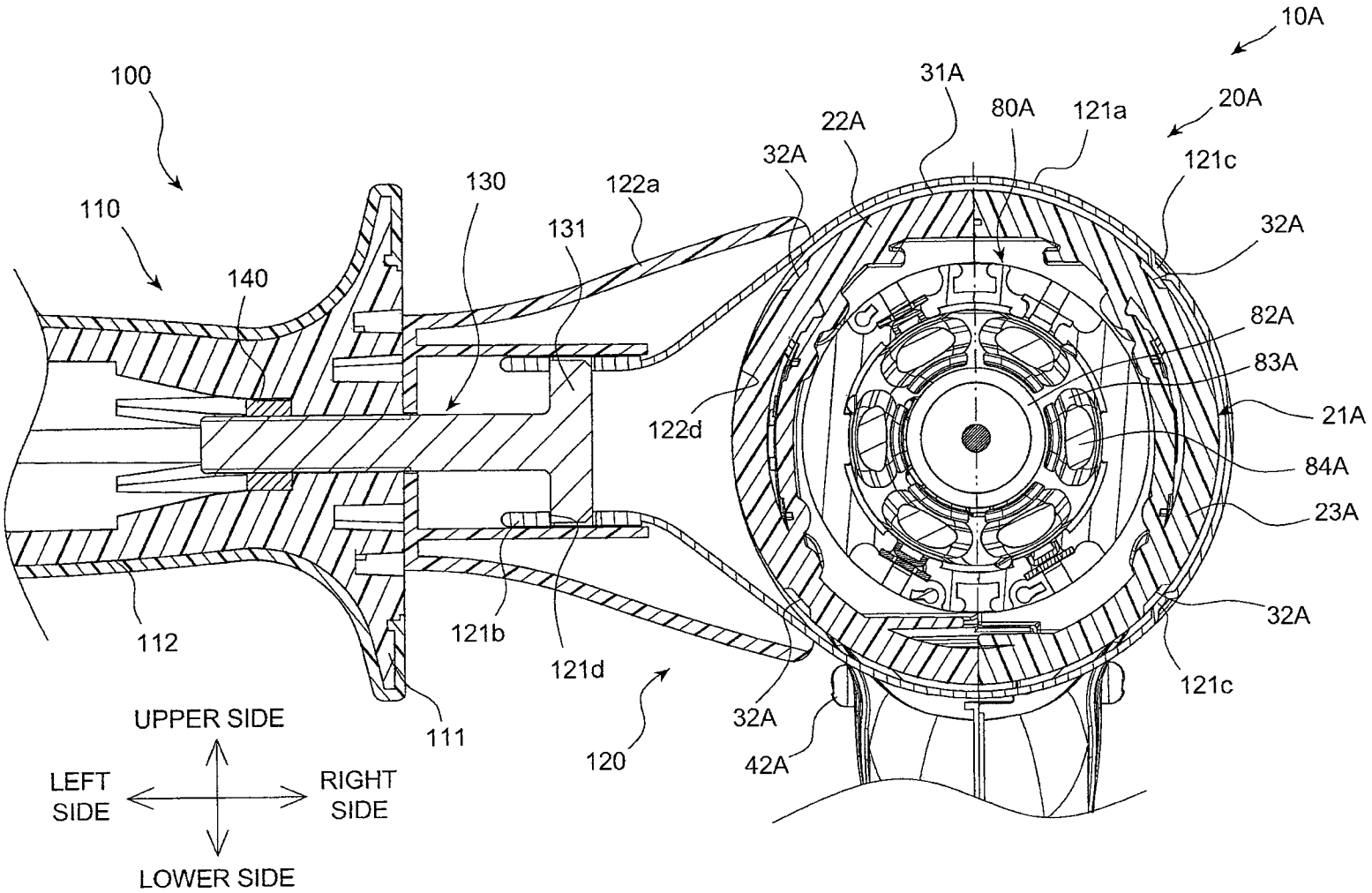
FIG. 11 is a partial cross sectional view of the main body portion of the power tool and a fixing portion of the auxiliary handle member illustrated in FIGS. 9 and 10 as taken along a section line 11-11 in FIG. 10.

Although the power tool 10 is illustrated as a driver drill in the first embodiment, the auxiliary handle mounting structure 30 according to the first embodiment is applicable to various types of power tools, such as a hammer driver drill, an impact driver, an impact wrench, etc. For example, FIGS. 8 to 11 illustrate a modified example in which an auxiliary handle mounting structure according to the first embodiment is applied to a power tool 10A. In this modified example, the power tool 10A is a driver drill that embodies a compact body and light weight design as compared to the power tool 10 illustrated in FIGS. 1 and 2. FIG. 8 is an exploded, side elevational view of the power tool 10A with the auxiliary handle member 100. Figure is a top plan view of the power tool 10A with the auxiliary handle member 100 showing a state in which the auxiliary handle member 100 is coupled to the power tool 10A. FIGS. 10 and 11 are a partial cross sectional views of the power tool 10A with the auxiliary handle member 100. More specifically, FIGS. 10 and 11 show the auxiliary handle member 100 with the power tool 10A before the fixing portion 120 of the auxiliary handle member 100 is completely tightened onto the power tool 10A.

As shown in FIGS. 8 to 11, the power tool 10A has a generally pistol-like overall shape formed by a generally tubular main body portion 20A and a grip portion 40A. An outer surface of at least a part of the main body portion 20A and the grip portion 40A are integrally formed by an outer housing cover 21A. More specifically, the outer housing cover 21A includes a left housing cover 22A and a right housing cover 23A that are fixed together by a plurality of screws S. Moreover, the main body portion 20A includes a speed change lever 25A for changing a rotational speed of the power tool 10A. The main body portion 20A further includes a plurality of openings defining front intake ports 27A and exhaust ports 29A. A lower end of the grip portion 40A includes a battery connecting portion 41A, which is coupled to the rechargeable battery B.

The power tool 10A further includes a rotational direction change lever 42A, a light unit 43A, a switch lever 50A, a tubular change-ring 60A coupled with a spindle 61A, a power tool chuck 70A, a motor unit 80A, and a gear assembly 90A as shown in FIG. 10. In the power tool 10A of this example, the motor unit 80A constitutes a conventional brushless motor, which includes a rotor having a magnet 82A, and a stator having stator coils 83A and a stator core 84A. The motor unit 80A further includes conventional components such as a circuit board 81A, an output shaft 85A, a fan 86A, and a rear bearing 88A. In FIG. 10, some parts of the motor unit 80A (such as the magnet 82A) are not shown in cross section for the sake of simplicity of illustration.

Moreover, in the power tool 10A of this example, the gear assembly 90A includes a front gear box 91A, a plurality of gears including an internal gear 92A, a rear gear box 93A, and a gear box lid 94A. The spindle 61A is rotatably supported by a pair of bearings 62A and 63A that are fixed to the front gear box 91A. A front bearing 95A is coupled to the gear box lid 94A for rotatably supporting the output shaft 85A of the motor unit 80A. The speed change lever 25A is operatively coupled to the internal gear 92A via a connecting ring 96A so that a rotational speed of the power tool 10A (i.e., a rotational speed of the spindle 61A) is changed by operating the speed change lever 25A. In this example, a conventional torque adjustment mechanism (clutch mechanism) including a coli spring 64A and a plurality of balls 97A is provided for preventing overtightening beyond desired torque.

Since the components of the power tool 10A, such as the tubular change ring 60A, the power tool chuck 70A, the motor unit 80A and the gear assembly 90A, are conventional components that are well known in the art, the structure of these components will not be discussed or illustrated in detail herein. Rather, it will be apparent to those skilled in the art from this disclosure that the components of the power tool 10A can have any type of suitable structure.

The main body portion 20A of the power tool 10A includes an auxiliary handle mounting structure 30A disposed between the rear end of the main body portion 20A and a rearmost end position R of a region where the grip portion 40A meets the main body portion 20A. The auxiliary handle mounting structure 30A has the same structure as the auxiliary handle mounting structure 30 of the power tool 10, and includes a generally cylindrical surface 31A and an engagement structure including four recesses 32A formed in the generally cylindrical surface 31A. The auxiliary handle mounting structure 30A is preferably integrally formed with the main body portion 20A of the housing of the power tool 10A. As shown in FIG. 10, the auxiliary handle mounting structure 30A is disposed at a position at least partially overlapping the motor unit 80A as viewed along a direction perpendicular to a rotational axis of the motor unit 80A, which coincides the center axis C of the main body portion 20A. More specifically, the auxiliary handle mounting structure 30A is preferably disposed at a position at least partially overlapping at least one of the rotor 81A and the stator 82A of the motor unit 80A as viewed along the direction perpendicular to the rotational axis of the motor unit 80A.

The auxiliary handle member 100 as shown in FIGS. 3 and 4 is attached to the auxiliary handle mounting structure 30A of the power tool 10A in the same manner as described above.

As shown in FIG. 8, the longitudinal length of the main body portion 20A of the power tool 10A in this modified example is shorter than a longitudinal length of the main body portion 20 of the power tool 10. However, in this modified example too, the auxiliary handle mounting structure 30A is disposed between the rear end of the main body portion 20A and the rearmost end position R of the region where the grip portion 40A meets the main body portion 20A as shown in FIG. 8. Moreover, as shown in FIG. 10, the auxiliary handle mounting structure 30A is disposed at a position at least partially overlapping the motor unit 80A as viewed along a direction perpendicular to the rotational axis of the motor unit 80A. In other words, the auxiliary handle member 100 is attached to the power tool 10A on the rear side of the main body portion 20A. Accordingly, with the power tool 10A according to this modified example, it is not necessary to provide an extra space in the front portion of the main body portion 20A for forming the auxiliary handle mounting structure 30A. In other words, even with the power tool 10A embodying a compact design, the space on the rear side of the main body portion 20A can be efficiently used to form the auxiliary handle mounting structure 30A without increasing the overall longitudinal length of the main body portion 20A of the power tool 10A. Thus, the usability of the power tool 10A with the auxiliary handle member 100 is improved even in a confined working space. Moreover, since the auxiliary handle member 100 is attached on the rear side of the grip portion 40A, the auxiliary handle member 100 is prevented from interfering with a target workpiece even when the target workpiece has a shape that bulges out towards the power tool 10A.

FIGS. 5 to 7 and 9 to 11 show examples in which the auxiliary handle member 100 is positioned with respect to the power tool 10 or 10A so that the auxiliary grip portion 110 is disposed on the left side of the main body portion 20 or 20A to generally form a right angle with respect to the grip portion 40 or 40A of the power tool 10 or 10A when viewed along the center axis C. However, it will be apparent to those skilled in the art from this disclosure that the auxiliary handle member 100 can be positioned with respect to the power tool 10 or 10A so that the auxiliary grip portion 110 is disposed on the right side of the main body portion 20 or 20A depending on the user's preference. Moreover, although the example in which four recesses 32, 32A are provided in the auxiliary handle mounting structure 30 or 32A is illustrated in this embodiment, the number of the recesses 32 or 32A can be increased to allow the user to select a number of different positions of the auxiliary handle member 100 with respect to the power tool 10 or 10A. For example, the recesses 32 or 32A may be provided to enable that the auxiliary handle member 100 to be attached to the power tool 10 or 10A so that the auxiliary grip portion 110 is oriented to form an angle other than a right angle with respect to the grip portion 40 or 40A of the power tool 10 or 10A to accommodate the user's preference or use the power tool 10 or 10A and the auxiliary handle member 100 in a confined space.

Furthermore, although the recesses 32 or 32A are provided in the auxiliary handle mounting structure 30 or 30A and the protrusions 121*c* are provided in the auxiliary handle member 100 in the first embodiment, the engagement structures formed in the auxiliary handle mounting structure 30 or 30A and the auxiliary handle member 100 may be arranged such that the auxiliary handle mounting structure 30 or 30A of the main body portion 20 or 20A includes at least one protrusion and the auxiliary handle member 100 includes at least one recess or opening that engages with the protrusion.

Although the cordless power tool 10 or 10A is illustrated as an example of a power tool in the first embodiment, the power tool is not limited to a cordless tool coupled to a rechargeable battery. It will be apparent to those skilled in the art from this disclosure that the auxiliary handle mounting structure 30 or 30A according to the first embodiment is applicable to a corded power tool with a power cable.

Second Embodiment

Referring now to FIGS. 12 to 16, a power tool 10B with an auxiliary handle member 100' in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity. The parts of the second embodiment that differ from the parts of the first embodiment will be indicated with a single prime (').

The second embodiment differs from the first embodiment in that the power tool 10B is a small size power tool. A "small size" power tool as used herein is defined as a power tool having a rechargeable battery with a maximum voltage of 12.0 V or less, or a power tool having a net weight of less than about 1.3 kg. For example, the power tool 10B according to the second embodiment illustrated in FIGS. 12 to 16 has a net weight of about 1.0 kg, and is coupled to a rechargeable battery B' with a maximum voltage of 10.8 V.

Figure 12:
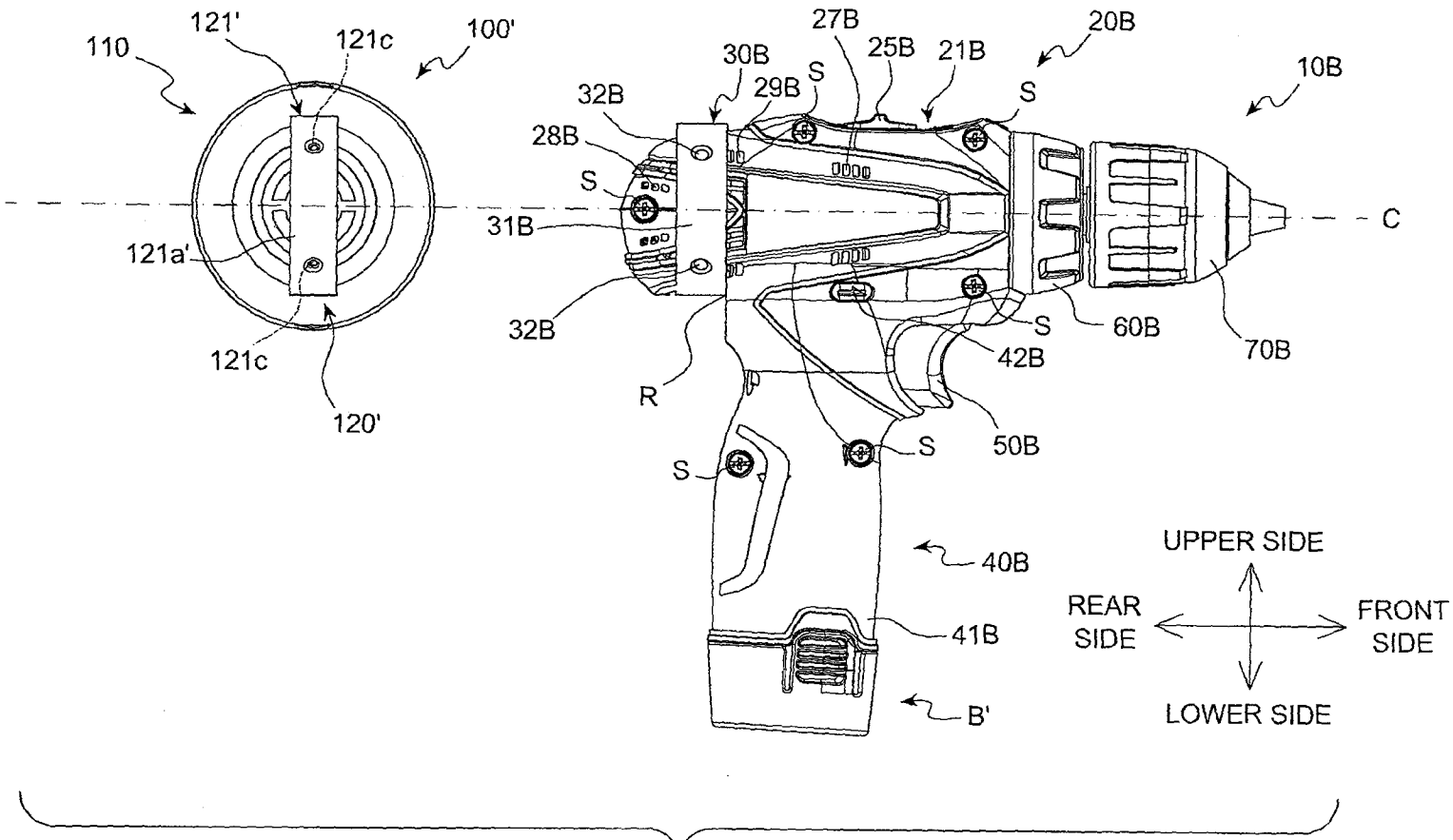
FIG. 12 is an exploded, side elevational view of a power tool with an auxiliary handle member according to a second embodiment.
Figure 13:
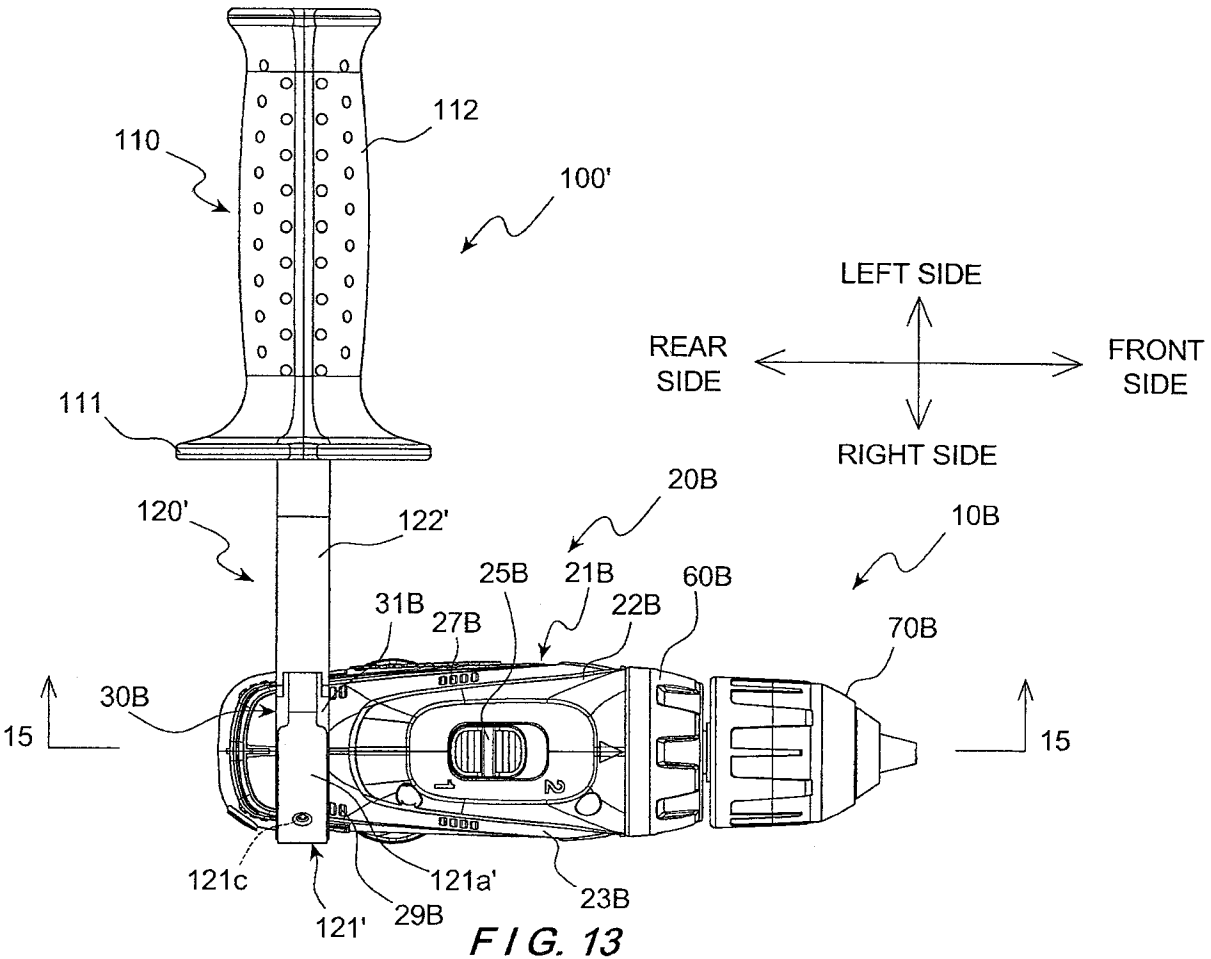
FIG. 13 is a top plan view of the power tool with the auxiliary handle member illustrated in FIG. 12, illustrating a state in which the auxiliary handle member is coupled to the power tool.

As shown in FIGS. 12 and 13, the power tool 10B is a small size driver drill, and has a generally pistol-like overall shape formed by a generally tubular main body portion 20B and a grip portion 40B. An outer surface of at least a part of the main body portion 20B and the grip portion 40B are integrally formed by an outer housing cover 21B. More specifically, the outer housing cover 21B includes a left housing cover 22B and a right housing cover 23B that are fixed together by a plurality of screws S. Moreover, the main body portion 20B includes a speed change lever 25B for changing a rotational speed of the power tool 10B. The main body portion 20B further includes a plurality of openings defining front intake ports 27B, rear intake ports 28B and exhaust ports 29B. A lower end of the grip portion 40B includes a battery connecting portion 41B, which is coupled to the rechargeable battery B'. The rechargeable battery B' serves as a power source for the power tool 10B.

Figure 15:
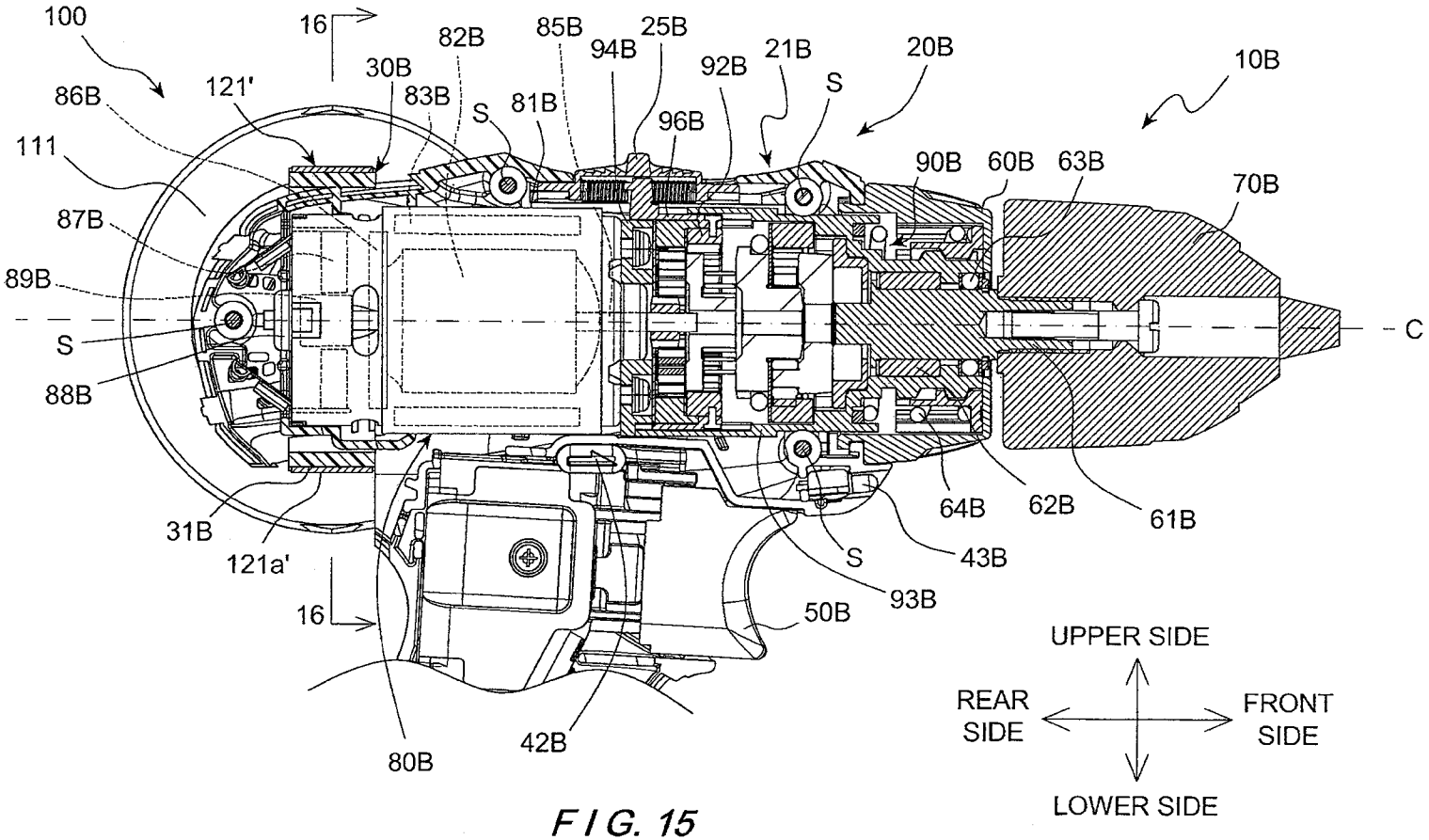
FIG. 15 is a partial cross sectional view of a main body portion of the power tool with the auxiliary handle member illustrated in FIG. 13 as taken along a section line 15-15 in FIG. 13.
Figure 16:
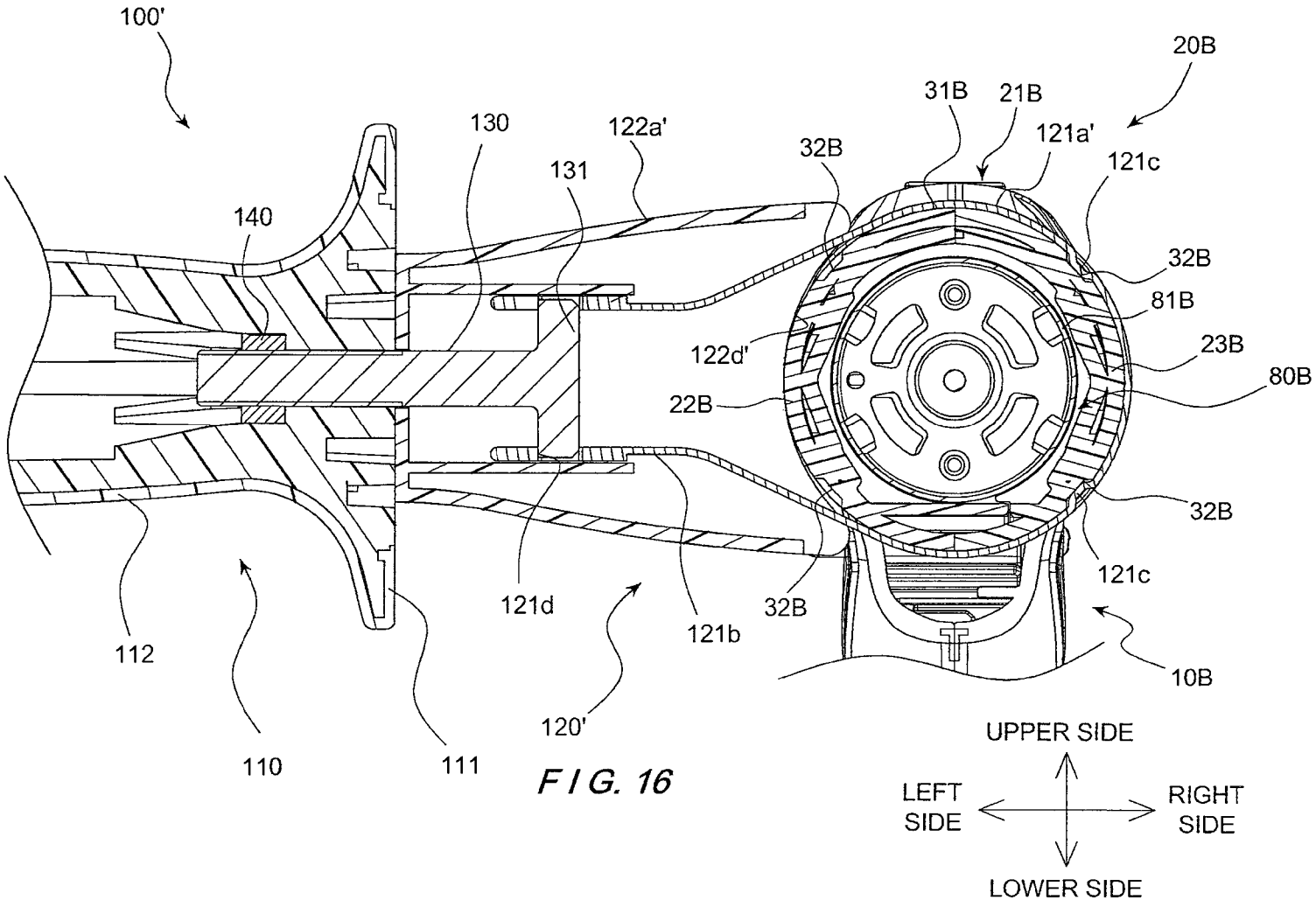
FIG. 16 is a partial cross sectional view of the main body portion of the power tool and a fixing portion of the auxiliary handle member illustrated in FIGS. 13 and 16 as taken along a section line 16-16 in FIG. 15.

The power tool 10B further includes a rotational direction change lever 42B, a light unit 43B, a switch lever 50B, a tubular change-ring 60B coupled with a spindle 61B, a power tool chuck 70B, a motor assembly 80B, and a gear assembly 90B as shown in FIG. 15. As shown in FIGS. 15 and 16, in the power tool 10B according to the second embodiment, the motor assembly 80B includes a generally cylindrical motor casing member 81B (such as a steel-can) that encloses conventional motor components, such as a rotor including an armature 82B with an armature core and armature coils, a stator including a magnet 83B, a fan 86B, a brush 87B, a commutator 89B, and the like. An armature shaft 85B protrudes from a front end of the motor casing member 81B to be operatively coupled to the gear assembly 90B. Thus, the motor assembly 80B is installed in the main body portion 20B of the power tool 10B as an integrated motor module. Such an integrated arrangement of the motor assembly 80B enables the size and weight of the power tool 10B to be reduced.

Moreover, in the power tool 10B of this embodiment, the gear assembly 90B includes a plurality of gears including an internal gear 92B, a gear box 93B, and a gear box lid 94B. The spindle 61B is rotatably supported by a pair of bearings 62B and 63B that are fixed to the gear box 93B. A front end portion of the motor assembly 80B is supported by the gear box lid 94B so that rotation of the armature shaft 85B is input to the gear assembly 90B. The speed change lever 25B is operatively coupled to the internal gear 92B via a connecting ring 96B so that a rotational speed of the power tool 10B (i.e., a rotational speed of the spindle 61B) is changed by operating the speed change lever 25B. A conventional clutch mechanism including a coil spring 64B is provided for preventing overtightening beyond desired.

Since these components of the power tool 10B, such as the tubular change ring 60B, the power tool chuck 70B, the motor assembly 80B and the gear assembly 90B, are conventional components that are well known in the art, the structure of these components will not be discussed or illustrated in detail herein. Rather, it will be apparent to those skilled in the art from this disclosure that the components of the power tool 10B can be any type of suitable structure.

The main body portion 20B of the power tool 10B includes an auxiliary handle mounting structure 30B disposed between the rear end of the main body portion 20B and a rearmost end position R of a region where the grip portion 40B meets the main body portion 20B. The auxiliary handle mounting structure 30B has the same structure as the auxiliary handle mounting structure 30 of the power tool 10 in the first embodiment except for its size, and includes a generally cylindrical surface 31B and an engagement structure including four recesses 32B formed in the generally cylindrical surface 31B. The auxiliary handle mounting structure 30B is preferably integrally formed with the main body portion 20B of the housing of the power tool 10B. As shown in FIG. 15, the auxiliary handle mounting structure 30B is disposed at a position at least partially overlapping the motor assembly 80B as viewed along a direction perpendicular to a rotational axis of the motor assembly 80B, which coincides the center axis C of the main body portion 20B. More specifically, the auxiliary handle mounting structure 30B is preferably disposed at a position at least partially overlapping the motor casing member 81B of the motor assembly 80B as viewed along the direction perpendicular to the rotational axis of the motor assembly 80B.

Figure 14:
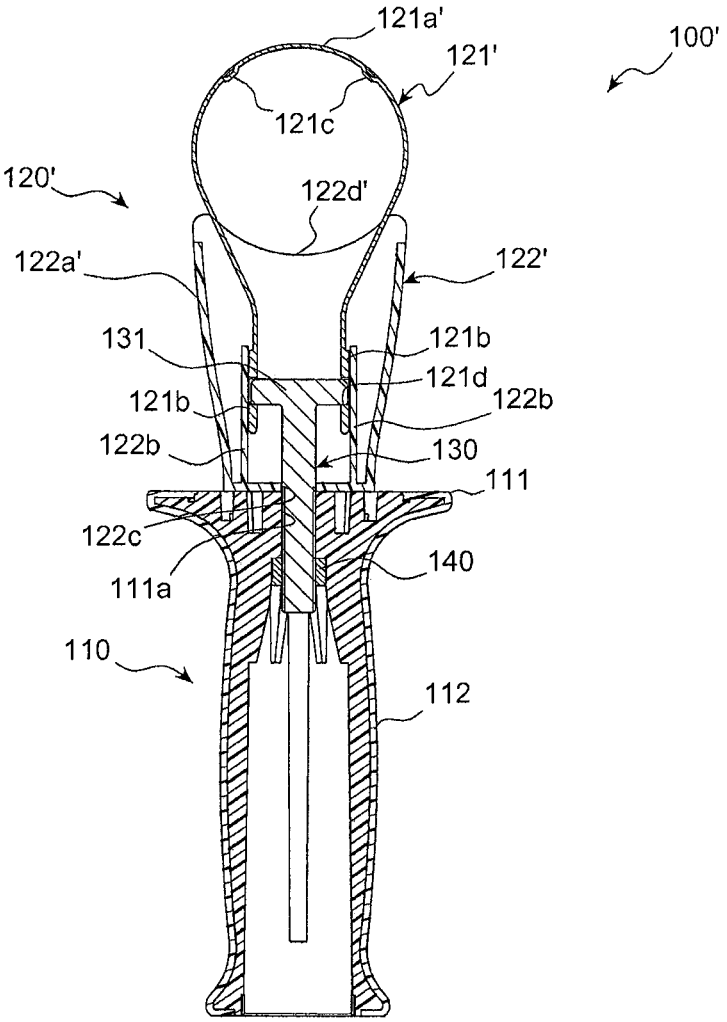
FIG. 14 is a longitudinal cross-sectional view of the auxiliary handle member illustrated in FIGS. 12 and 13.

FIG. 14 shows a longitudinal cross-sectional view of the auxiliary handle member 100' according to the second embodiment. The structure of the auxiliary handle member 100' of the second embodiment is basically the same as the structure of the auxiliary handle member 100 illustrated in FIGS. 3 and 4 in the first embodiment except for the sizes of the fastening member 121' and a case member 122' of a fixing portion 120'. More specifically, an abutment section 122*d'* of the case member 122' and an inner diameter of a ring section 121*a'* formed by the fastening member 121' are smaller in the auxiliary handle member 100' in the second embodiment so that the fixing portion 120' is securely tightened onto the auxiliary handle mounting structure 30B of the small size power tool 10B.

The auxiliary handle member 100' is attached to the auxiliary handle mounting structure 30B of the power tool 10B in the same manner as described above in the first embodiment. FIG. 13 shows the auxiliary handle member 100' and the power tool 10B when the fixing portion 120' of the auxiliary handle member 100' is coupled to the auxiliary handle mounting structure 30B of the power tool 10B. FIGS. 15 and 16 are cross-sectional views of the auxiliary handle member 100' and the power tool 10B illustrating a state in which the fixing portion 120' of the auxiliary handle member 100' has been tightened onto the auxiliary handle mounting structure 30B of the power tool 10B.

Similarly to the first embodiment, the auxiliary handle mounting structure 30B according to the second embodiment is disposed between the rear end of the main body portion 20B and the rearmost end position R of the region where the grip portion 40B meets the main body portion 20B as shown in FIG. 12. Moreover, as shown in FIG. 15, the auxiliary handle mounting structure 30B is disposed at a position at least partially overlapping the motor assembly 80B as viewed along a direction perpendicular to the rotational axis of the motor assembly 80B. In other words, the auxiliary handle member 100' is attached to the power tool 10B on the rear side of the main body portion 20B. Accordingly, with the power tool 10B according to the second embodiment, it is not necessary to provide an extra space in the front portion of the main body portion 20B for forming the auxiliary handle mounting structure 30B. In other words, even with the small size power tool 10B, the space on the rear side of the main body portion 20B can be efficiently used to form the auxiliary handle mounting structure 30B without increasing the overall longitudinal length of the main body portion 20B of the power tool 10B. Thus, the usability of the power tool 10B with the auxiliary handle member 100' is improved even in a confined working space. Moreover, since the auxiliary handle member 100' is attached on the rear side of the grip portion 40B, the auxiliary handle member 100' is prevented from interfering with a target workpiece even when the target workpiece has a shape that bulges out towards the power tool 10B.

Moreover, with the second embodiment, even the small size power tool 10B can be held steadily by both hands against the reaction force during operation of the power tool 10B by using the auxiliary handle member 100'. Using the auxiliary handle member 100' is even more advantageous when the power tool 10B is lightweight and prone to be affected by the reaction force imparted onto the power tool 10B during operation.

FIGS. 12 to 16 show an example in which the auxiliary handle member 100' is positioned with respect to the power tool 10B so that the auxiliary grip portion 110 is disposed on the left side of the main body portion 20B. However, it will be apparent to those skilled in the art from this disclosure that the auxiliary handle member 100' can be positioned with respect to the power tool 10B so that the auxiliary grip portion 110 is disposed on the right side of the main body portion 20B depending on the user's preference. Moreover, although the example in which four recesses 32B are provided in the auxiliary handle mounting structure 30B is illustrated in this embodiment, the number of the recesses 32B can be increased to allow the user to select a number of different positions of the auxiliary handle member 100' with respect to the power tool 10B.

Furthermore, although the recesses 32B are provided in the auxiliary handle mounting structure 30B and the protrusions 121*c* are provided in the auxiliary handle member 100' in the second embodiment, the engagement structures formed in the auxiliary handle mounting structure 30B and the auxiliary handle member 100' may be arranged such that the auxiliary handle mounting structure 30B of the main body portion 20B includes at least one protrusion and the auxiliary handle member 100' includes at least one recess or opening that engages with the protrusion.

Although a driver drill is illustrated as the small size power tool 10B in the second embodiment, the auxiliary handle mounting structure 30B according to the second embodiment is applicable to various types of small size power tools, such as a hammer driver drill, an impact driver, an impact wrench, etc.

Third Embodiment

Referring now to FIGS. 17 to 23, a power tool 10C with an auxiliary handle member 200 in accordance with a third embodiment will now be explained. In view of the similarity between the first and third embodiments, the parts of the third embodiment that are identical to the parts of the first embodiment will be given the same reference numerals as the parts of the first embodiment. Moreover, the descriptions of the parts of the third embodiment that are identical to the parts of the first embodiment may be omitted for the sake of brevity.

The power tool 10C with the auxiliary handle member 200 according to the third embodiment differs from the previous embodiments in that, in the third embodiment, the auxiliary handle member 200 is coupled to the power tool 10C such that a part of the auxiliary handle member 200 extends through inside of the power tool 10C. Therefore, the auxiliary handle member 200 can be securely anchored in the power tool 10C. Accordingly, misalignment or detachment of the auxiliary handle member 200 during operation can be prevented.

As shown in FIGS. 17 and 20-23, the power tool 10C has a similar configuration as the power tool 10A illustrated in FIGS. 8-11 except for the structure of an auxiliary handle mounting structure 30C. More specifically, the power tool 10C is a driver drill having a generally pistol-like overall shape formed by a generally tubular main body portion 20C and a grip portion 40C. An outer surface of at least a part of the main body portion 20C and the grip portion 40C are integrally formed by an outer housing cover 21C. More specifically, the outer housing cover 21C includes a left housing cover 22C and a right housing cover 23C that are fixed together by a plurality of screws S. Moreover, the main body portion 20C includes a speed change lever 25C for changing a rotational speed of the power tool 10C. The main body portion 20C further includes a plurality of openings defining front intake ports 27C and exhaust ports 29C. A lower end of the grip portion 40C includes a battery connecting portion 41C, which is coupled to the rechargeable battery B.

Figure 22:
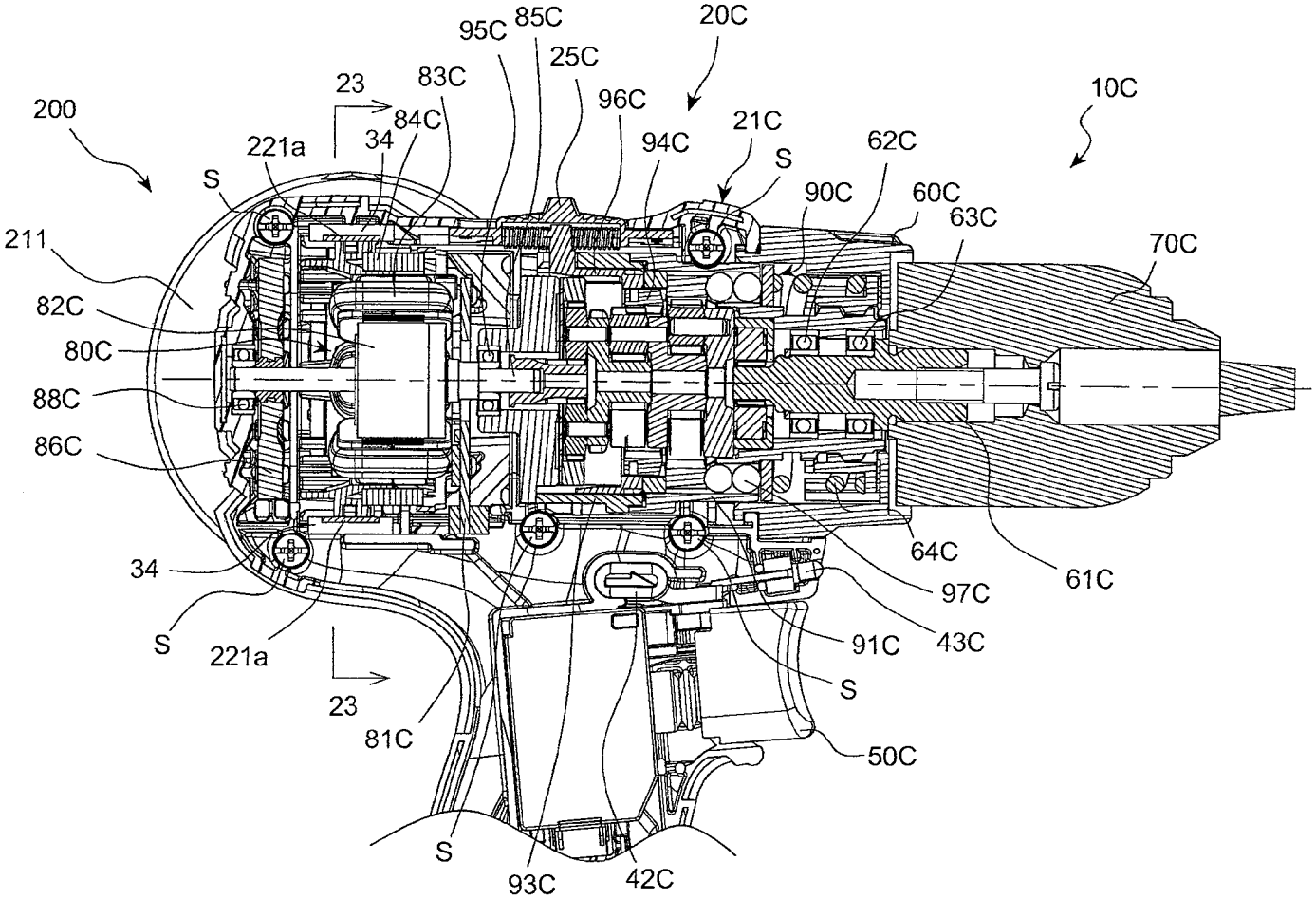
FIG. 22 is a partial cross sectional view of a main body portion of the power tool with the auxiliary handle member illustrated in FIGS. 20 and 21 as taken along a section line 22-22 in FIG. 20.

The power tool 10C further includes a rotational direction change lever 42C, a light unit 43C, a switch lever 50C, a tubular change-ring 60C coupled with a spindle 61C, a power tool chuck 70C, a motor unit 80C, and a gear assembly 90C as shown in FIG. 22. In the power tool 10C of this example, the motor unit 80C constitutes a conventional brushless motor, which includes a rotor having a magnet 82C, and a stator having stator coils 83C and a stator core 84C. The motor unit 80C further includes conventional components such as a circuit board 81C, an output shaft 85C, a fan 86C, and a rear bearing 88C. In FIG. 22, some parts of the motor unit 80C (such as the magnet 82C) are not shown in cross section for the sake of simplicity of illustration.

Moreover, in the power tool 10C of this embodiment, the gear assembly 90C includes a front gear box 91C, a plurality of gears including an internal gear 92C, a rear gear box 93C, and a gear box lid 94C. The spindle 61C is rotatably supported by a pair of bearings 62C and 63C that are fixed to the front gear box 91C. A front bearing 95C is fixedly coupled to the gear box lid 94C for rotatably supporting the output shaft 85C of the motor unit 80C. The speed change lever 25C is operatively coupled to the internal gear 92C via a connecting ring 96C so that a rotational speed of the power tool 10C (i.e., a rotational speed of the spindle 61A) is changed by operating the speed change lever 25C. A conventional torque adjustment mechanism (clutch mechanism) including a coli spring 64C and a plurality of balls 97C is provided for preventing overtightening beyond desired torque.

Since these components of the power tool 10C, such as the tubular change ring 60C, the power tool chuck 70C, the motor unit 80C and the gear assembly 90C, are conventional components that are well known in the art, the structure of these components will not be discussed or illustrated in detail herein. Rather, it will be apparent to those skilled in the art from this disclosure that the components of the power tool 10C can be any type of suitable structure.

Figure 17:
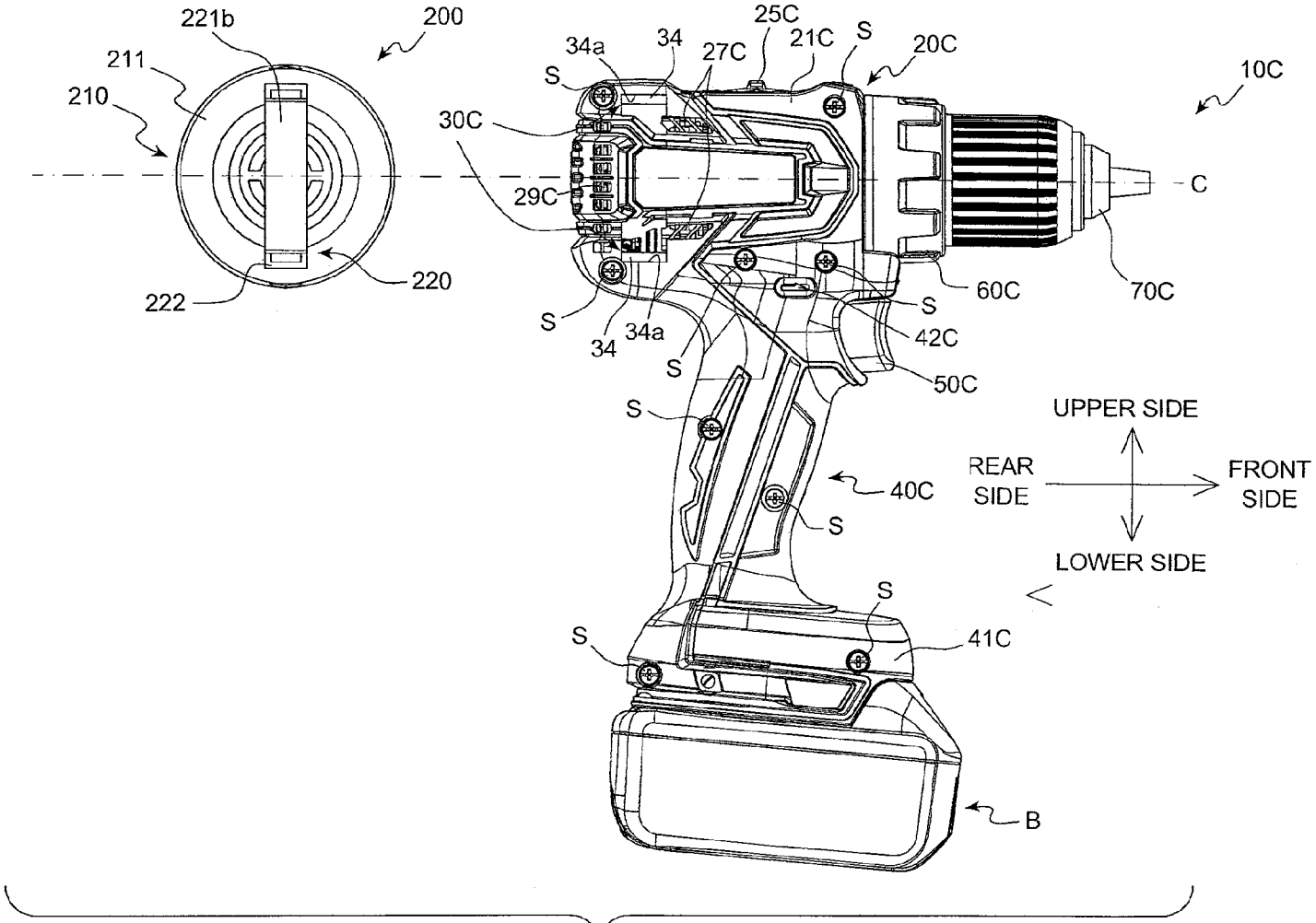
FIG. 17 is an exploded, side elevational view of a power tool with an auxiliary handle member according to a third embodiment.

As shown in FIG. 17, the main body portion 20C of the power tool 10C includes the auxiliary handle mounting structure 30C disposed in a rear portion of the main body portion 20C. The auxiliary handle mounting structure 30C according to the third embodiment defines a pair of through-holes 34 extending through the main body portion 20C. More specifically, each of the through-hole 34 of the auxiliary handle mounting structure 30C are defined by a pair of openings 34*a* formed at corresponding positions on each side of the outer housing cover 21C of the main body portion 20C and a hollow space inside the main body portion 20C disposed between the openings on each side. In other words, the positions of the openings 34*a* formed in the outer housing cover 21C are set so that the through-holes 34 are positioned so as not to interfere with internal components disposed inside the main body portion 20C. Therefore, the auxiliary handle mounting structure 30C can be formed on the power tool 10C in a simple manner without additional parts.

In the third embodiment, the through-holes 34 are arranged so that center axes of the through-holes 34 extend parallel to each other in a direction substantially perpendicular to a rotational axis of the motor unit 80C, which coincides the center axis C of the main body portion 20C. More specifically, in the third embodiment, the center axes of the through-holes 34 extends in a direction that generally forms a right angle with respect to the grip portion 40C of the power tool 10C when viewed along the center axis C of the main body portion 20C. One of the through-holes 34 is disposed above the motor unit 80C, and the other of the through-holes 34 is disposed below the motor unit 80C as shown in FIG. 22.

Figure 19:
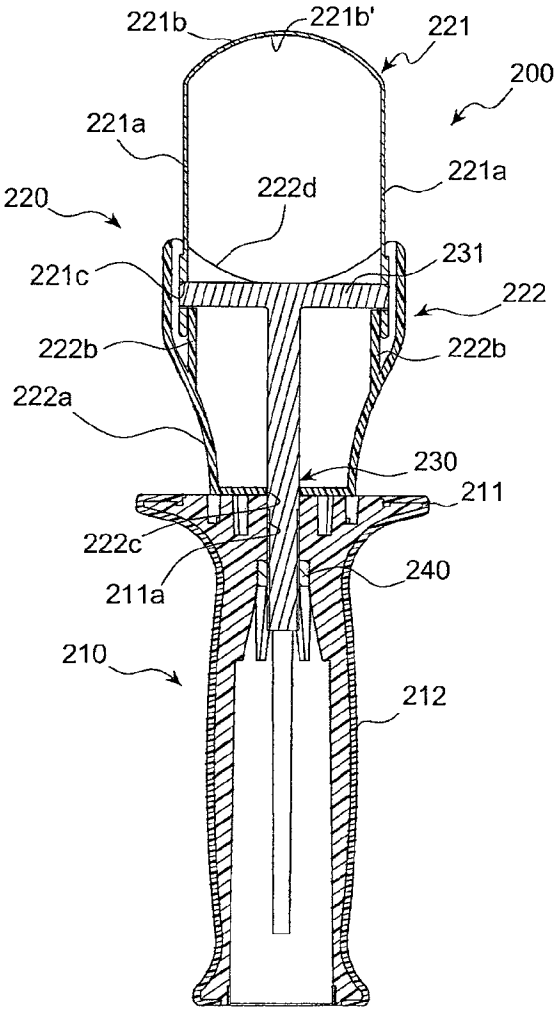
FIG. 19 is a longitudinal cross sectional view of the auxiliary handle member illustrated in FIG. 18.
Figure 18:
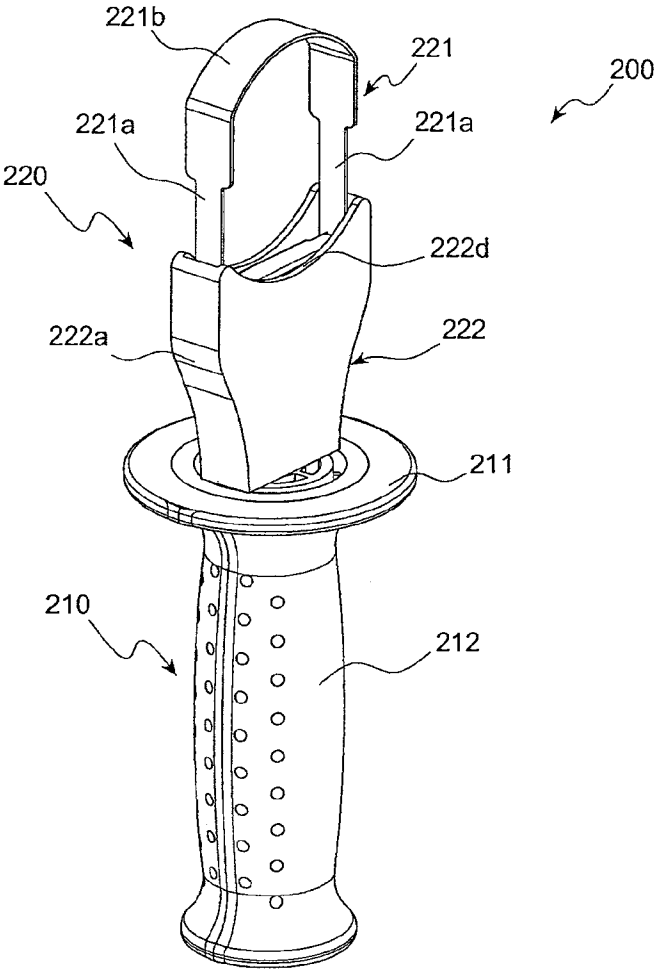
FIG. 18 is a perspective view of the auxiliary handle member illustrated in FIG. 17.
Figure 20:
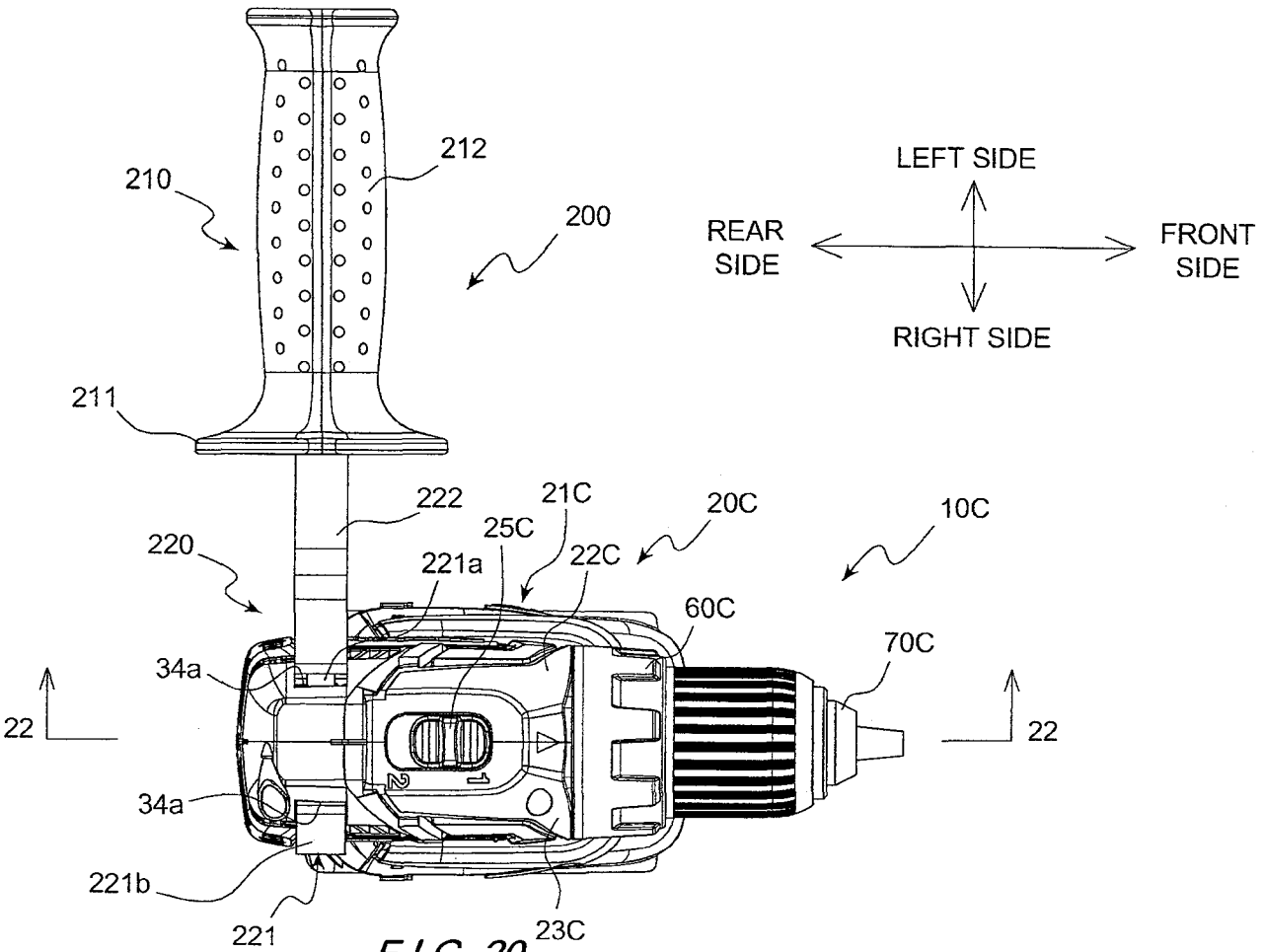
FIG. 20 is a top plan view of the power tool with the auxiliary handle member illustrated in FIGS. 17 to 19, showing a state in which the auxiliary handle member is coupled to the power tool.
Figure 21:
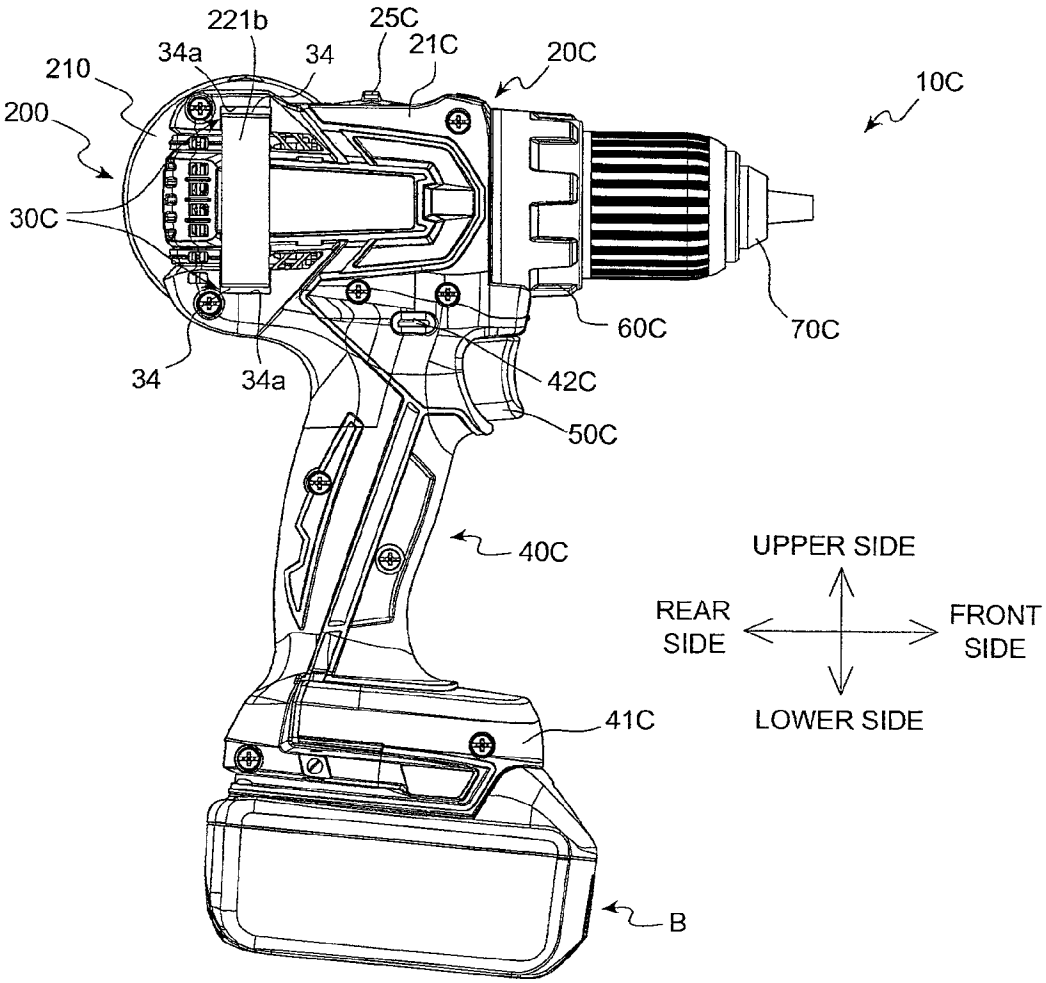
FIG. 21 is a side elevational view of the power tool with the auxiliary handle member illustrated in FIG. 20, showing the state in which the auxiliary handle member is coupled to the power tool.

Referring now to FIGS. 18 and 19, the structure of the auxiliary handle member 200 will be described. The auxiliary handle member 200 has a similar configuration as the auxiliary handle member 100 of the first embodiment illustrated in FIGS. 3 and 4 except for the structure of a fixing portion 220. More specifically, the auxiliary handle member 200 includes an auxiliary grip portion 210 and the fixing portion 220 rotatably coupled to the auxiliary grip portion 210 by a bolt 130 and a nut 240. The fixing portion 220 is configured and arranged to be fixed to the auxiliary handle mounting structure 30C of the main body portion 20C of the power tool 10C as described in more detail below.

The auxiliary grip portion 210 of the auxiliary handle member 200 includes a flange section 211 and a body section 212. As shown in FIG. 4, a through-hole 211*a* is formed in the flange section 211 for passing the bolt 230. The nut 240 engages the bolt 230 to fix the bolt 230 to an inner end part of the through-hole 211*a*. An outer surface of the body section 212 is preferably made of rubber or plastic material, and may be provided with an anti-slip surface structure or coating to prevent the user's hand from slipping during operation.

As shown in FIGS. 18 and 19, the fixing portion 220 of the auxiliary handle member 200 includes a fastening member 221 and a case member 222. The fastening member 221 is formed by a strip element, and includes a pair of linear insertion sections 221*a* and a bridge section 221*b* extending between the insertion sections 221*a*. As shown in FIG. 18, the fastening member 221 includes a wider width section in a middle region in a longitudinal direction of the fastening member 221 and narrower width sections at distal end regions of the fastening member 221. Any suitable material, such as metal, resin, etc. can be used to form the fastening member 221. The insertion sections 221*a* are dimensioned to extend through the through-holes 34 of the auxiliary handle mounting structure 30C formed in the main body portion 20C of the power tool 10C when the auxiliary handle member 200 is coupled to the power tool 10. The bridge section 221*b* of the fastening member 221 has an inner surface 221*b*' that generally matches a contour of an outer surface of the outer housing cover 21C of the main body portion 20C at the auxiliary handle mounting structure 30C. In this embodiment, the bridge section 221*b* is formed in an arcuate shape so that the inner surface 221*b*' generally matches an arcuate contour of the outer housing cover 21C as shown in FIG. 23.

A distal end portion of each of the insertion sections 221*a* of the fastening member 221 defines an opening 221*d* through which one end of a head part 231 of the bolt 230 is inserted as shown in FIG. 19, with the head part 231 of the bolt 230 having a generally rectangular shape.

The case member 222 of the fixing portion 220 accommodates and supports the fastening member 221 with a majority of the fixing portion 220 being exposed. The case member 222 includes an outer cover 222*a* and a pair of inner walls 222*b*. The outer cover 222*a* is generally rectangular in cross-section. The outer cover 222*a* accommodates the narrower width sections of the fastening member 221. The inner walls 222*b* extend parallel to each other between opposing surfaces of the outer cover 222*a*. The inner walls 222*b* slideably support the insertion sections 221*a* of the fastening member 221 with the head part 231 of the bolt 230 being coupled to the insertion sections 221*a* as shown in FIG. 4. As shown in FIG. 19, distal ends of the inner walls 222*b* abut against the head part 231 of the bolt 230 to firmly secure the fastening member 221 onto the fixing portion 220 when the fixing portion 220 is tightened onto the auxiliary grip portion 210. A through-hole 222*c*, through which the bolt 230 passes, is provided at a bottom surface of the case member 222. An open end of the outer cover 222*a* includes an abutment section 222*d* having an outline that generally matches a contour of an outer surface of the outer housing cover 21C at the auxiliary handle mounting structure 30C.

Figure 23:
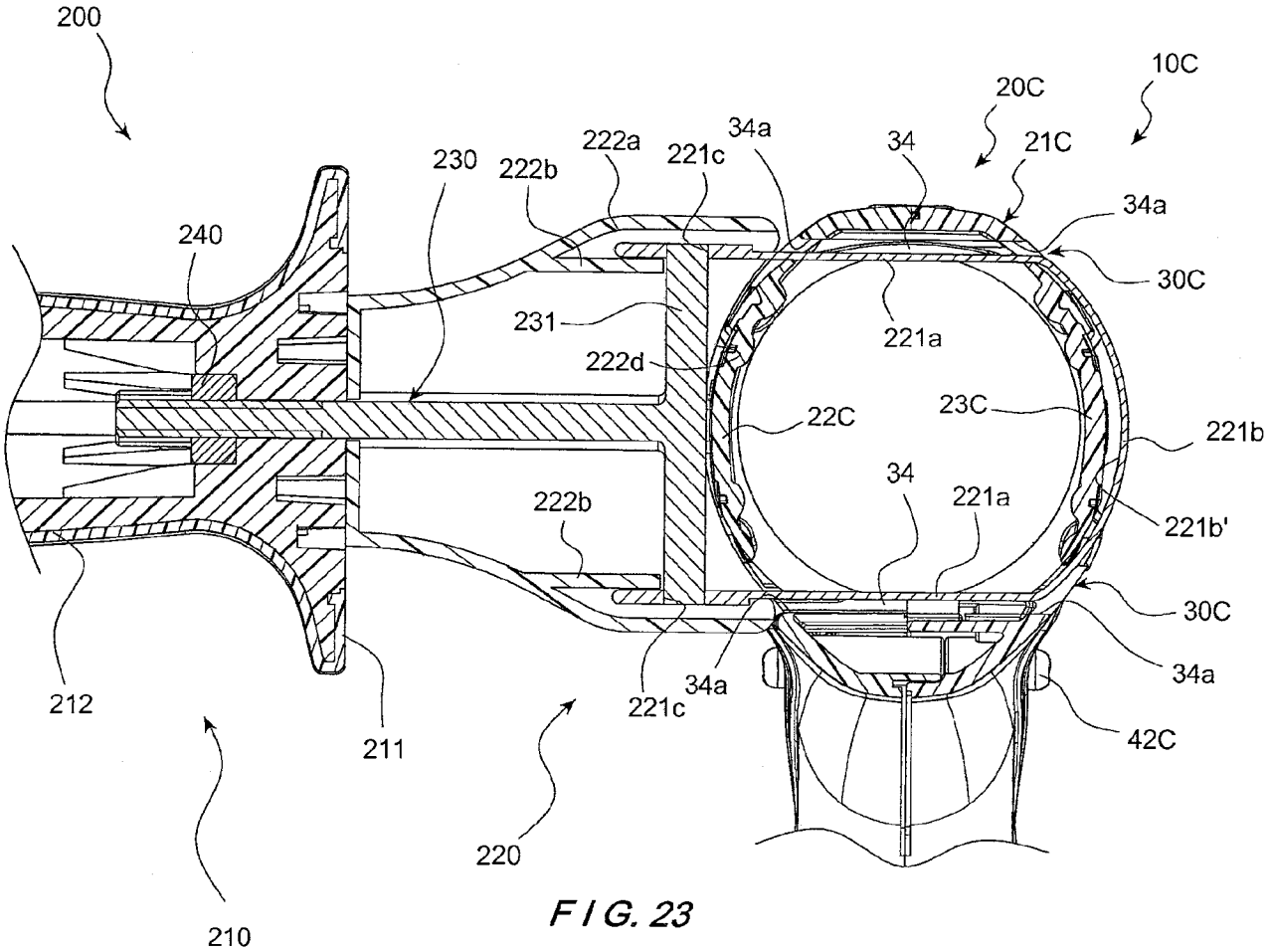
FIG. 23 is a partial cross sectional view of the main body portion of the power tool and a fixing portion of the auxiliary handle member illustrated in FIG. 22 as taken along a section line 23-23 in FIG. 22.

FIGS. 20 to 23 illustrate the auxiliary handle member 200 and the power tool 10C when the fixing portion 220 of the auxiliary handle member 200 is coupled to the auxiliary handle mounting structure 30C of the power tool 10C. In FIG. 23, only an outer housing cover 21C of the main body portion 20C is shown and the internal components of the main body portion 20C are omitted for the sake of simplicity of illustration.

When the auxiliary handle member 200 is attached to the power tool 10C, at first, the auxiliary grip portion 210 of the auxiliary handle member 200 is rotated in a first direction (e.g., counterclockwise) with respect to the case member 222 to move the bolt 230 in a direction in which the bolt 230 protrudes from the nut 240, and the fastening member 221, the case member 222 and the bolt 230 are disassembled. Then, the distal ends of the insertion sections 221*a* of the fastening member 221 are inserted into the through-holes 34 of the auxiliary handle mounting structure 30C formed in the main body portion 20C of the power tool 10C. The insertion sections 221*a* extend through the through-holes 34 so that the bridge section 221*b* is disposed on one side of the main body portion 20C and the distal ends of the insertion sections 221*a* protrude outwardly from the openings 34*a* of the through-holes 34 on the other side of the main body portion 20C as shown in FIG. 23. Then, each end part of the head part 231 of the bolt 230 is inserted into each of the openings 221*c* formed at the distal end portions of the insertion sections 221*a*. The case member 222 is coupled to the assembly of the fastening member 221 and the bolt 230 so that the bolt 230 passes through the center hole 222*c* of the case member 222. At this time, inner surfaces of the distal ends of the insertion sections 221*a* are supported by outer surfaces of the inner walls 222*b*. Next, the nut 240 fixed in the auxiliary grip portion 210 and the bolt 230 are engaged, and the auxiliary grip portion 210 of the auxiliary handle member 200 is turned in a second direction (e.g., clockwise) with respect to the case member 222 to move the bolt 230 with respect to the nut 240 in a direction in which the case member 222 and the grip portion 210 move closer together. Therefore, the fixing portion 220 of the auxiliary handle member 200 is securely fastened onto the power tool 10C as the main body portion 20C is clutched between the fastening member 221 and the abutment sections 222*d* of the case member 222 with the insertion sections 221*a* extending through the through-holes 34.

With the power tool 10C according to the third embodiment, the auxiliary handle member 200 is coupled to the power tool 10C so that a part of the auxiliary handle member 200 pass through inside of the main body portion 20C of the power tool 10C. Therefore, the auxiliary handle member 200 can be prevented from misaligning or accidentally slipping off during operation. Thus, the auxiliary handle member 200 can be secured to the power tool 10C with high reliability.

FIGS. 20 to 23 show an example in which the auxiliary handle member 200 is positioned with respect to the power tool 10C so that the auxiliary grip portion 210 is disposed on the left side of the main body portion 20C to generally form a right angle with respect to the grip portion 40C of the power tool 10C when viewed along the center axis C. However, it will be apparent to those skilled in the art from this disclosure that the auxiliary handle member 200 can be positioned with respect to the power tool 10C so that the auxiliary grip portion 210 is disposed on the right side of the main body portion 20C depending on the user's preference. Moreover, although the example in which two through-holes 34 are provided in the auxiliary handle mounting structure 30C is illustrated in this embodiment, the number of the through-holes 34 can be varied to allow the user to select a number of different positions of the auxiliary handle member 200 with respect to the power tool 10C. For example, the through-holes 34 may be provided to enable that the auxiliary handle member 200 to be attached to the power tool 10C so that the auxiliary grip portion 210 is oriented to form an angle other than a right angle with respect to the grip portion 40C of the power tool 10C to accommodate the user's preference or use the power tool 10C with the auxiliary handle member 200 in a confined space. Moreover, multiple through-holes 34 may be provided in different longitudinal positions of the main body portion 20C so that the user can select the longitudinal position for attaching the auxiliary handle member 200.

In the third embodiment, the auxiliary handle mounting structure 30C is disposed in the rear portion of the main body portion 20C. However, it will be apparent to those skilled in the art from this disclosure that the position of the auxiliary handle mounting structure 30C according to the third embodiment is not limited to the rear portion of the main body portion 20C. In other words, the auxiliary handle mounting structure having at least one through-hole can be formed in any longitudinal position of the main body portion as long as provision of such a through-hole does not interfere with internal components of the power tool.

Moreover, although a driver drill is illustrated as the power tool 10C in the third embodiment, the auxiliary handle mounting structure 30C according to the third embodiment is applicable to various types of power tools, such as a hammer driver drill, an impact driver, an impact wrench, etc. including the small size power tools as defined in the second embodiment. Moreover, the auxiliary handle mounting structure 30C according to the third embodiment is also applicable to a power tool having a housing that does not have a generally pistol-like overall shape. For example, the auxiliary handle mounting structure 30C may be applied to a power tool having a generally linear-shape housing such as an angle drill or the like.

Although a cordless power tool is illustrated as an example of the power tool 10C in the third embodiment, the power tool is not limited to a cordless tool coupled to a rechargeable battery. It will be apparent to those skilled in the art from this disclosure that the auxiliary handle mounting structure 10C according to the third embodiment is applicable to a corded power tool with a power cable.

In the illustrated embodiments, the auxiliary handle member 100 or 200 is configured such that the entire auxiliary grip portion 110 or 210 rotates with respect to the case member 122 or 222 to tighten the fixing portion 120 or 220 onto the auxiliary handle mounting structure of the power tool. However, the flange section 111 or 211 and the body section 112 or 212 of the auxiliary grip portion 110 or 210 may be formed as separate members so that only the flange section 111 or 211 is rotated with respect to the fixing portion 120 or 220. Moreover, the auxiliary handle member 100 or 200 may be provided with an additional attachment part such as a depth gage and the like.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiments, the following directional terms "front", "rear", "above", "downward", "vertical", "horizontal", "below" and "transverse" as well as any other similar directional terms refer to those directions of a power tool when the power tool is oriented as shown in FIG. 2. Accordingly, these terms, as utilized to describe the present invention should be interpreted relative to the power tool. The terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A power tool comprising:

a main body portion including a motor unit; and a grip portion extending from the main body portion between a front end and a rear end of the main body portion, the main body portion further including an auxiliary handle mounting structure including a generally cylindrical surface disposed between the rear end of the main body portion and a rearmost end of a region where the grip portion meets the main body portion.

2. The power tool according to claim 1, further comprising an auxiliary handle member coupled to the auxiliary handle mounting structure of the main body portion.

3. The power tool according to claim 2, wherein the auxiliary handle member includes an auxiliary grip portion and a fixing portion coupled to the auxiliary grip portion, the fixing portion being fixed to the auxiliary handle mounting structure of the main body portion.

4. The power tool according to claim 2, wherein the auxiliary handle member includes an auxiliary grip portion and a fixing portion coupled to the auxiliary grip portion, the fixing portion including an inner surface that matches the generally cylindrical surface of the main body portion.

5. The power tool according to claim 4, wherein the auxiliary handle mounting structure of the main body portion further includes an engagement structure formed in the generally cylindrical surface, and the fixing portion of the auxiliary handle member includes an engagement structure that engages with the engagement structure formed in the generally cylindrical surface of the auxiliary handle mounting structure.

6. The power tool according to claim 5, wherein the engagement structure of the auxiliary handle mounting structure of the main body portion includes a recess formed in the generally cylindrical surface, the engagement structure of the fixing portion of the auxiliary handle member includes a protrusion that fits in the recess formed in the generally cylindrical surface of the auxiliary handle mounting structure.

7. The power tool according to claim 1, further comprising a power tool chuck disposed in a front side of the main body portion.

8. The power tool according to claim 1, wherein the auxiliary handle mounting structure of the main body portion further includes an engagement structure formed in the generally cylindrical surface.

9. The power tool according to claim 8, wherein the engagement structure of the auxiliary handle mounting structure of the main body portion includes a recess formed in the generally cylindrical surface.

10. The power tool according to claim 1, further comprising a rechargeable battery with a maximum voltage of 12.0 V or less.

11. The power tool according to claim 1, wherein the motor unit is enclosed by a generally cylindrical motor casing member disposed inside an outer housing cover of the main body portion.

12. A power tool comprising:

a main body portion including a motor unit including a rotor and a stator; and a grip portion extending from the main body portion between a front end and a rear end of the main body portion, the main body portion further including an auxiliary handle mounting structure disposed between the rear end of the main body portion and a rearmost end of a region where the grip portion meets the main body portion, and the auxiliary handle mounting structure is disposed at a position at least partially overlapping at least one of the rotor and the stator as viewed along a direction perpendicular to a rotational axis of the motor unit.

13. A power tool comprising:

a main body portion including a motor unit including a rotor and a stator; and a grip portion extending from the main body portion between a front end and a rear end of the main body portion, the main body portion further including an auxiliary handle mounting structure disposed at a position the auxiliary handle mounting structure is disposed at the position at least partially overlapping at least one of the rotor and the stator as viewed along a direction perpendicular to a rotational axis of the motor unit.

14. The power tool according to claim 13, further comprising an auxiliary handle member coupled to the auxiliary handle mounting structure of the main body portion.

15. A power tool comprising:

a main body portion including a motor unit; and a grip portion extending from the main body portion, the main body portion further including an auxiliary handle mounting structure defining a through-hole extending through the main body portion, the through-hole being defined by a pair of openings formed in an outer housing cover on each side of the main body portion and a hollow space inside the main body portion extending between the openings.

16. The power tool according to claim 15, further comprising an auxiliary handle member coupled to the auxiliary handle mounting structure of the main body portion such that a part of the auxiliary handle member extends through the through-hole of the main body portion.

17. The power tool according to claim 15, wherein the through-hole extends in a direction substantially perpendicular to a rotational axis of the motor unit.

18. The power tool according to claim 15, wherein the auxiliary handle mounting structure defines an additional through-hole extending through the main body portion.

19. The power tool according to claim 18, wherein the through-hole and the additional through-hole extend along axes that are parallel to each other.

20. The power tool according to claim 18, further comprising an auxiliary handle member coupled to the auxiliary handle mounting structure of the main body portion such that parts of the auxiliary handle member extend through the through-hole and the additional through-hole of the main body portion.

21. The power tool according to claim 20, wherein the auxiliary handle member includes an auxiliary grip portion and a fixing portion coupled to the auxiliary grip portion, the fixing portion including a pair of insertion sections respectively extending through the through-hole and the additional through-hole of the auxiliary handle mounting structure of the main body portion.

22. The power tool according to claim 21, wherein the fixing portion of the auxiliary handle member further includes a bridge section extending between the insertion sections, the bridge section having an inner surface that generally matches a contour of an outer surface of the main body portion.

23. The power tool according to claim 22, wherein the insertion sections and the bridge section of the fixing portion of the auxiliary handle member are formed by a strip element, with the insertion sections extending substantially straight and parallel to each other and the bridge section being curved to match the contour of the outer surface of the main body portion.

24. A power tool comprising:

a housing including a main body portion and a grip portion extending from the main body portion; and a motor assembly disposed in the main body portion of the housing, the motor assembly including a motor unit including a brush and a commutator, and a generally cylindrical motor casing member enclosing the motor unit, the main body portion of the housing including an auxiliary handle mounting structure configured and arranged to be coupled to an auxiliary handle member, the auxiliary handle mounting structure is disposed at a position at least partially overlapping at least one of the brush and the commutator as viewed along a direction perpendicular to a rotational axis of the motor unit.

25. The power tool according to claim 24, further comprising an auxiliary handle member coupled to the auxiliary handle mounting structure of the main body portion.

* * * * *